US011395384B2

(12) United States Patent
Takahashi et al.

(10) Patent No.: US 11,395,384 B2
(45) Date of Patent: Jul. 19, 2022

(54) LIGHT EMITTING DEVICE DRIVING APPARATUS, LIGHT EMITTING DEVICE DRIVING SYSTEM AND LIGHT EMITTING SYSTEM

(71) Applicant: Rohm Co., Ltd., Kyoto (JP)

(72) Inventors: Toru Takahashi, Kyoto (JP); Kei Nagao, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 117 days.

(21) Appl. No.: 16/799,182

(22) Filed: Feb. 24, 2020

(65) Prior Publication Data

US 2020/0275537 A1 Aug. 27, 2020

(30) Foreign Application Priority Data

Feb. 26, 2019 (JP) ..... JP2019032821

(51) Int. Cl.
*H05B 45/14* (2020.01)
*H05B 45/3725* (2020.01)
*H05B 45/325* (2020.01)

(52) U.S. Cl.
CPC ..... *H05B 45/14* (2020.01); *H05B 45/325* (2020.01); *H05B 45/3725* (2020.01)

(58) Field of Classification Search
None
See application file for complete search history.

(56) References Cited

U.S. PATENT DOCUMENTS 4,242,730 A * 12/1980 Golias ..... G01N 21/5907 346/33 A
5,347,201 A * 9/1994 Liang ..... H01J 1/18 315/366

(Continued)

FOREIGN PATENT DOCUMENTS

CN 101883458 11/2010
CN 101990715 3/2011

(Continued)

OTHER PUBLICATIONS

Partial English Translation of Office Action for corresponding Chinese Appln. No. 202010122197.1, dated Mar. 3, 2022, 11 pages.

*Primary Examiner* — Srinivas Sathiraju
(74) *Attorney, Agent, or Firm* — Fish & Richardson P.C.

(57) ABSTRACT

An object of the present invention is to optimize a light-emitting driving voltage for each light-emitting portion.
A light-emitting diode (LED) driver (10A) includes: driver blocks (20) of a plurality of channels, each driver block (20) having a light-emitting portion connecting terminal (CH) to be connected to a light-emitting portion (LL) including one or more than one LED, the light-emitting portion being caused to emit light by a current flowing through the light-emitting portion connecting terminal to the light-emitting portion; a lowest voltage detection circuit (40), detecting and outputting a lowest voltage among voltages of the light-emitting portion connecting terminals of each channel; a sample hold circuit (50), comparing an output voltage ($V_{LS}$) of the lowest voltage detection circuit with a hold voltage ($V_{LS_SH}$) thereof, and updating the hold voltage to the output voltage if the output voltage is lower than the hold voltage; and a feedback control circuit (60), outputting a feedback signal according to the hold voltage and a predetermined reference voltage to a power supply device (11) providing a light emission driving voltage (Vo) to the (Continued)

light-emitting portions of the plurality of channels, so as to control the light emission driving voltage.

13 Claims, 15 Drawing Sheets

(56) References Cited

U.S. PATENT DOCUMENTS 6,912,139 B2 * 6/2005 Kernahan ..... H03K 19/215 363/41
7,132,804 B2 * 11/2006 Lys ..... H05B 45/20 315/294
8,274,248 B2 * 9/2012 Hirata ..... H02P 6/06 323/283
8,373,358 B2 * 2/2013 Hsu ..... H05B 45/46 315/297
9,232,579 B2 * 1/2016 Sasaki ..... G09G 3/3406
9,282,606 B1 * 3/2016 Kuang ..... H05B 45/14
9,374,083 B2 * 6/2016 Sawada ..... H03K 17/51
9,648,676 B2 * 5/2017 Angeles ..... H05B 45/3725
9,877,367 B2 * 1/2018 Wang ..... H05B 45/10
10,676,017 B2 * 6/2020 Murakami ..... B60Q 1/14
10,887,957 B2 * 1/2021 Chen ..... H05B 47/10
11,089,663 B2 * 8/2021 Nishigami ..... H05B 45/14
2002/0161511 A1 * 10/2002 Fujikawa ..... G01S 7/06 701/522
2004/0095020 A1 * 5/2004 Kernahan ..... G05F 3/262 307/35
2004/0095108 A1 * 5/2004 Kernahan ..... H03K 19/0963 323/282
2004/0095109 A1 * 5/2004 Kernahan ..... H02M 1/0845 323/282
2007/0239003 A1 * 10/2007 Shertukde ..... A61B 8/565 600/463
2007/0262966 A1 * 11/2007 Nishimura ..... G06F 3/0443 345/173
2009/0009486 A1 * 1/2009 Sato ..... G06F 3/04166 345/174
2009/0230891 A1 * 9/2009 Zhao ..... H05B 45/46 315/308
2010/0134040 A1 6/2010 Elder
2011/0121744 A1 * 5/2011 Salvestrini ..... H05B 47/175 315/246
2011/0227497 A1 * 9/2011 Hu ..... H05B 45/46 315/224
2013/0320880 A1 * 12/2013 Walker ..... H05B 45/3725 363/125
2014/0042924 A1 * 2/2014 Lee ..... H05B 45/00 315/210
2015/0054418 A1 * 2/2015 King ..... H05B 45/3575 315/209 R
2015/0366018 A1 * 12/2015 Kuang ..... H05B 45/385 315/206
2017/0272093 A1 * 9/2017 Kim ..... H03M 1/785
2018/0174507 A1 * 6/2018 Ohara ..... H01L 51/50
2018/0373094 A1 * 12/2018 Ryoo ..... H05B 45/46
2019/0229630 A1 * 7/2019 Halberstadt ..... H02M 1/088
2019/0254130 A1 * 8/2019 Chen ..... H05B 45/14
2020/0275537 A1 * 8/2020 Takahashi ..... H05B 45/14
2020/0314368 A1 * 10/2020 Tsukuda ..... H04N 5/359

FOREIGN PATENT DOCUMENTS

| | | |
|---|---|---|
| CN | 102045921 | 5/2011 |
| CN | 102136252 | 7/2011 |
| CN | 202258258 | 5/2012 |
| CN | 203722871 | 7/2014 |
| EP | 2448013 | 5/2012 |
| JP | 2013-222515 | 10/2013 |

* cited by examiner

[First reference operation example ($V_{LS}=V_{LS_SH}$, process), situation $\alpha$]

[Operation example EX1_1, situation α]

[Second reference operation example (no reset process), situation β

[Operation example EX1_2, situation β

LIGHT EMITTING DEVICE DRIVING APPARATUS, LIGHT EMITTING DEVICE DRIVING SYSTEM AND LIGHT EMITTING SYSTEM

BACKGROUND OF THE INVENTION

Field of the Invention

The present invention relates to a light-emitting device driving apparatus, a light-emitting device driving system and a light-emitting system.

Description of the Prior Art

In a liquid-crystal display (LCD) panel, a light-emitting portion consisting of a light-emitting diode (LED) is often used as a backlight, and an LED driver is used as an apparatus for driving the light-emitting portion. In the recent years, in response to high dynamic range (HDR) imaging, an LED driver capable of local dimming is required.

FIG. 17 shows a configuration of a light-emitting system including an LED driver 910. The LED driver 910 is configured to be capable of performing local dimming. In the light-emitting system in FIG. 17, a backlight portion 912 is formed by multiple light-emitting portions each having one or more than one LED. The light-emitting portions are disposed between a power supply device 911 and the LED driver 910. The LED driver 910 adjusts the light emission brightness of each light-emitting portion by controlling the current flowing to each light-emitting portion according to the output voltage of the power supply device 911. Thereby, local dimming corresponding to the number of light-emitting portions can be achieved.

PRIOR ART DOCUMENT

Patent Publication

[Patent document 1] Japan Patent Publication No. JP2013-222515

SUMMARY OF THE INVENTION

Problems to be Solved by the Invention

Due to an error in the forward voltage of each LED forming a light-emitting portion, various kinds of errors are present in the voltage drop in the light-emitting portion when a current flows. Considering such error, the output voltage (light emission driving voltage) of the power supply device 911 is determined or controlled. A required voltage is not applied to each light-emitting portion if the output voltage of the power supply device 911 is too low, and a large amount of heat is produced if the output voltage of the power supply device 911 is too high. Preferably, heat generation is suppressed as much as possible.

In aim of optimization of the output voltage of the power supply device 911, an approach of feeding back voltage information dependent on the voltage drop in each light-emitting portion to the power supply device 911 has also been studied. However, at this point, it is necessary to avoid situations where the output voltage of the power supply device fluctuates frequently (with associated details to be described shortly).

Further, an LED forming the light-emitting device of the light-emitting portion is given as an example, an LED driver serving as a light-emitting device driving apparatus is given as an example, and related situations of the light-emitting device driving apparatus are described. However, the same issue described above can also exist in a light-emitting device driving apparatus processing a light-emitting device other than the LED.

It is an object of the present invention to provide a light-emitting device driving apparatus, a light-emitting device driving system and a light-emitting system beneficial for the optimization of a light emission driving voltage.

Technical Means for Solving the Problem

A light-emitting device driving apparatus of the present invention is configured as below (first configuration), that is, the light-emitting device driving apparatus includes driver blocks of multiple channels, each driving block having a light-emitting portion connecting terminal to be connected to a light-emitting portion including one or more than one light-emitting device, the light-emitting portion caused to emit light by a current flowing through the light-emitting portion connecting terminal to the light-emitting portion; the light-emitting device driving apparatus further including: a lowest voltage detection circuit, detecting and outputting a lowest voltage among voltages of the light-emitting portion connecting terminals of each channel; a sample hold circuit, comparing an output voltage of the lowest voltage detection circuit with a hold voltage thereof, and updating the hold voltage to the output voltage if the output voltage is lower than the hold voltage; and a feedback control circuit, outputting a feedback signal according to the hold voltage and a predetermined reference voltage to a power supply device providing a light emission driving voltage to the light-emitting portions of the multiple channels, thereby controlling the light emission driving voltage.

The light-emitting device driving apparatus in the first configuration can also be configured as below (second configuration): each driver block further includes a constant current circuit providing a constant current flowing through the light-emitting portion connecting terminal to the light-emitting portion, and a switching element connected in series on a path along which the constant current flows, wherein the light-emitting portion is pulsed to emit light by controlling turning on and off of the switching element.

The light-emitting device driving apparatus in the first configuration or the second configuration can also be configured as below (third configuration): the feedback control circuit generates the feedback signal in a manner that, the light emission driving voltage decreases if the hold voltage is higher than the reference voltage, and the light emission driving voltage increases if the hold voltage is lower than the reference voltage.

The light-emitting device driving apparatus in any of the first to the third configurations can also be configured as below (fourth configuration): the sample hold circuit is configured to be capable of performing a reset process for setting the hold voltage to a predetermined initial voltage.

The light-emitting device driving apparatus in the fourth configuration can also be configured as below (fifth configuration): the sample hold circuit starts periodic execution of the reset process if a predetermined condition is true, and ends the periodic execution of the reset process according to a relationship between the hold voltage updated to the output voltage of the lowest voltage detection circuit and the reference voltage.

The light-emitting device driving apparatus in any of the first to fifth configurations can also be configured as below (sixth configuration): the multiple light-emitting portions of each channels are connected in parallel to the light-emitting portion connecting terminal, and the light emission driving voltage is selectively applied in a time division manner to the multiple light-emitting portions.

The light-emitting device driving apparatus in any of the first to sixth configurations can also be configured as below (seventh configuration): the light-emitting device driving apparatus includes a housing having a first side and a third side opposite to each other and a second side and a fourth side opposite to each other, the light-emitting portion connecting terminals of the multiple channels are arranged throughout the first side, the second side and the third side, and a feedback signal output terminal for outputting the feedback signal is arranged on the fourth side.

The light-emitting device driving apparatus in the seventh configuration can also be configured as below (eighth configuration): the light-emitting device driving apparatus is configured to be capable of communicating with an external apparatus, and a communication terminal for communicating with the external apparatus is arranged on the third side.

The light-emitting device driving apparatus in the eighth configuration can also be configured as below (ninth configuration): on the third side, the communication terminal is arranged closer to the fourth side than the light-emitting portion connecting terminal.

A light-emitting device driving system of the present invention is configured as below (tenth configuration), that is, the light-emitting device driving system includes: the light-emitting device driver apparatus of any of the first to ninth configurations; and a power supply device, generating and outputting the light emission driving voltage according to the feedback signal from the light-emitting device driving apparatus.

A light-emitting system of the present invention is configured as below (eleventh configuration), that is, the light-emitting system includes the light-emitting device driver apparatus of any of the first to ninth configurations; a power supply device, generating and outputting the light emission driving voltage according to the feedback signal from the light-emitting device driving apparatus; and the light-emitting portions of the multiple channels.

Alternatively, a light-emitting system of the present invention is configured as below (twelfth configuration), that is, the light-emitting system includes: the light-emitting device driving apparatus in the sixth configuration; a power supply device, generating the light emission driving voltage according to the feedback signal from the light-emitting device driving apparatus, and outputting the light emission driving voltage from an output terminal thereof; and light-emitting portions of the multiple channels. Wherein, the multiple channels include $1^{st}$ to $N^{th}$ channels (where N is an integer equal or more than 2), $1^{st}$ to $M^{th}$ light-emitting portions (where M is an integer equal or more than 2) are connected in parallel to the light-emitting portion connecting terminal of each channel, a $1^{st}$ switching element connected in series between the output terminal of the power supply device and the $1^{st}$ light-emitting portion of each channel, a $2^{nd}$ switching element connected in series between the output terminal of the power supply device and the $2^{nd}$ light-emitting portion of each channel, . . . and an $M^{th}$ switching element connected in series between the output terminal of the power supply device and the $M^{th}$ light-emitting portion of each channel; the light-emitting device driving apparatus further includes a switch control circuit, the switch control circuit selectively applying the light emission driving voltage in a time division manner to the $1^{st}$ to $M^{th}$ light-emitting portions of each channel by controlling turning on and off the $1^{st}$ to $M^{th}$ switching elements.

Effects of the Invention

A light-emitting device driving apparatus, a light-emitting driving system and a light-emitting system beneficial for optimization of a light emission driving voltage are provided according to the present invention.

DETAILED DESCRIPTION OF THE EMBODIMENTS

Details of the present invention are given in preferred embodiments with the accompanying drawings below. In the reference drawings, the same part is represented by the same denotation, and repeated description related to the same part is in principle omitted. Further, for brevity of the description, information, signals, physical quantities or names of components corresponding to signs or symbols representing information, signals, physical quantities or components of denotation references can be omitted or abbreviated. For example, as "40" is used to refer to a lowest voltage detection circuit (referring to FIG. 4), the description can recite "a lowest voltage detection circuit 40" or "a circuit 40", which however refer to the same component.

Some terms used in the description of the embodiments of the present invention are first explained. A ground wire refers to a conductive portion having a reference potential of 0 V or the reference potential itself. In the embodiments of the present invention, a voltage indicated without a specific reference is a potential observed from the ground wire. A level refers to the level of a potential, and for any signal or voltage, a high level has a level higher than that of a low level. Any switching element can be formed by one or more than one field-effect transistor (FET). When a switching element is in a turned-on state, two terminals of the switching element are connected. On the other, when a switching element is in a turned-off state, two terminals of the switching element are disconnected. The turned-on and turned-off state of any switching element can also be merely expressed as on and off.

First Embodiment

Figure 1:
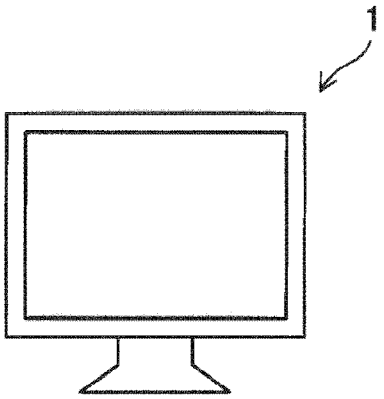
FIG. 1 is a brief appearance diagram of a display apparatus according to a first embodiment of the present invention.

A first embodiment of the present invention is described below FIG. 1 shows a brief appearance diagram of a display apparatus 1 according to the first embodiment of the present invention. In FIG. 1, a fixed television receiver is used as the display apparatus 1. However, the display apparatus 1 can also be designed as a portable display apparatus, or be assembled in any apparatus (a personal computer and so on) having a display function.

Figure 2:
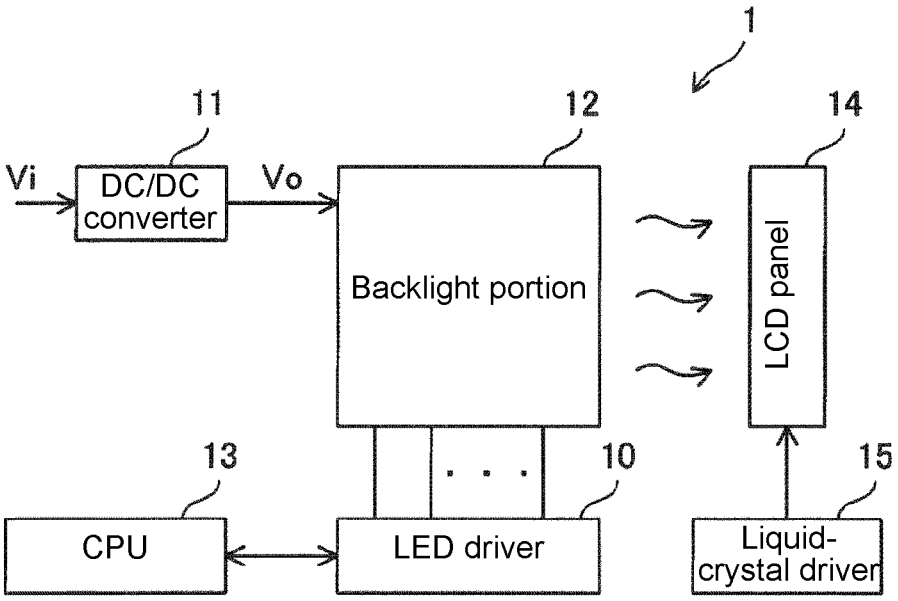
FIG. 2 is a brief internal block diagram of a display apparatus 1 according to the first embodiment of the present invention.

FIG. 2 shows a brief internal block diagram of the display apparatus 1. The display apparatus 1 includes a light-emitting diode (LED) driver 10 serving as a semiconductor device, a DC/DC converter 11, a backlight portion 12, a central processing unit (CPU) 13, a liquid-crystal display (LCD) panel 14 and a liquid-crystal driver 15. Further, in FIG. 2, among the constituting components of the display apparatus 1, only main parts related to the present invention are depicted, and other constituting components not shown in FIG. 2 can also be included in the display apparatus 1.

The LCD panel 14 includes multiple pixels arranged in a matrix. Multiple data lines and multiple scan lines are provided in the LCD panel 14, and the pixels are arranged at intersections of the data lines and the scan lines.

The liquid-crystal driver 15 receives image data representing an image (in other words, a picture) to be displayed on the LCD panel 14, and applies a voltage to the LCD panel 14 according to the image data so as to form on the LCD panel 14 an image based on the image data. The liquid-crystal driver 15 includes data drivers applying a driving voltage corresponding to the image data to the multiple data lines, and gate drivers sequentially selecting the multiple scan lines. The liquid-crystal driver 15 applies the voltage to the LCD panel 14 according to the image data at time points of a vertical synchronization signal Vsync and a horizontal synchronization signal Hsync generated according to an oscillation circuit (not shown) in the display apparatus 1.

The DC/DC converter 11 performs power conversion (DC-DC conversion) of a DC input current Vi to generate a DC output current Vo. The input voltage Vi is a positive DC voltage (e.g., 12 V), and the output voltage Vo is also a positive DC voltage. However, the value of the output voltage Vo can be variably controlled (e.g., variably controlled within a range between 20 V and 40 V). The input voltage Vi can be provided from outside the display apparatus 1, or can be generated by other power supply circuits in the display apparatus 1. A power supply circuit (not shown) including a DC/DC converter 11 is provided in the display apparatus 1, and the constituting components provided in the display apparatus 1 are driven according to a voltage generated by the power supply circuit.

The backlight portion 12 functions as a light source for the LCD panel 14. The backlight portion 12 includes multiple light-emitting portions, and the LCD panel 14 visually displays the image by using light emitted from the light-emitting portions. Each light-emitting portion includes one or more than one LED, and emits light based on the output voltage Vo of the DC/DC converter 11.

The LED driver 10 drives the light-emitting portions forming the backlight portion 12. The CPU 13 is an example of an external apparatus with respect to the LED driver 10. The CPU 13 and the LED driver 10 can be connected to each other in a form capable of bidirectional communication. Under the control of the CPU 13, the LED driver 10 adjusts the light emission brightness of the light-emitting portions forming the backlight portion 12.

Figure 3:
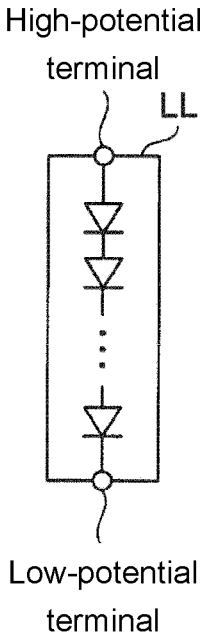
FIG. 3 is a configuration diagram of a light-emitting portion according to the first embodiment of the present invention.

FIG. 3 shows a configuration of a light-emitting portion LL. The backlight portion 12 is formed by providing multiple light-emitting portions LL. The light-emitting portion LL is formed by connecting multiple LEDs in series. The light-emitting portion LL has a high-potential terminal and a low-potential terminal, and each LED forming the light-emitting portion LL has a forward direction in a direction from the high-potential terminal to the low-potential terminal. However, the light-emitting portion LL can also be formed by one LED. In this case, the anode and the cathode of one single LED forming the light-emitting portion LL are respectively equivalent to the high-potential terminal and the low-potential terminal.

Figure 4:
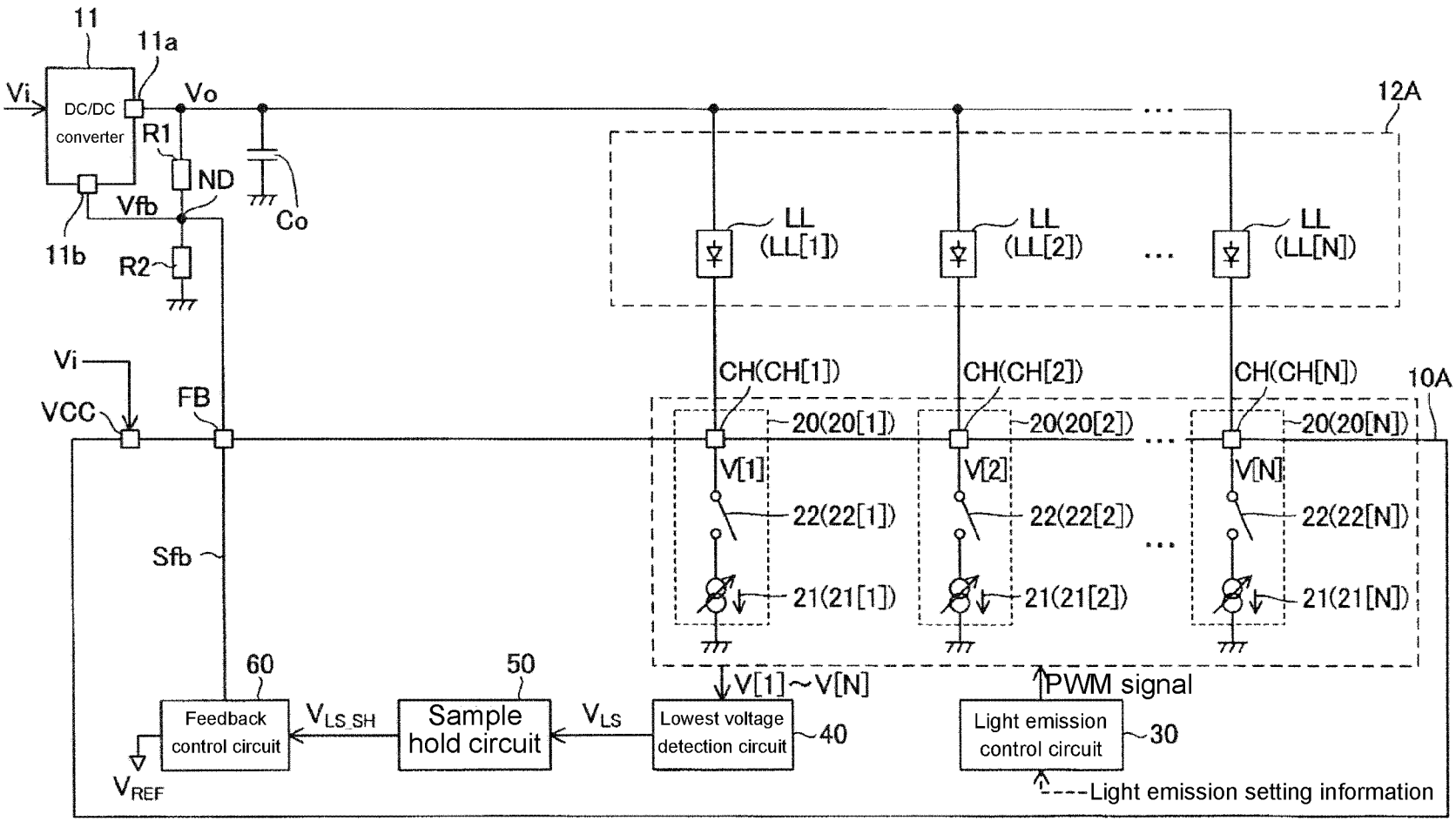
FIG. 4 is a configuration diagram of a backlight portion and parts related light emission control according to the first embodiment of the present invention.

FIG. 4 shows the connection relationship of an LED driver 10A, the DC/DC converter 11 and a backlight portion 12A according to the first embodiment of the present invention, and the configurations of the LED driver 10A and the backlight portion 12A according to the first embodiment of the present invention. The LED driver 10A and the backlight portion 12A are respectively examples of the LED driver 10 and the backlight portion 12 in FIG. 2.

The DC/DC converter 11 generates the output voltage Vo by, for example, pulse-width modulating the input voltage Vi. The output voltage Vo has a positive DC voltage value. The DC/DC converter 11 has an output terminal 11*a* and a feedback input terminal 11*b*, and the output voltage Vo is outputted from the output terminal 11*a*. The output voltage Vo is divided by a series circuit of a resistor R1 and a resistor R2. More specifically, the output terminal 11*a* is connected to one terminal of the resistor R1, and the other terminal of the resistor R1 is connected to the ground wire via the resistor R2. Further, an output capacitor Co is disposed between the output terminal 11*a* and the ground wire. The voltage generated at a connecting node ND between the resistors R1 and R2 is referred to as a feedback voltage Vfb. The feedback voltage Vfb is dependent on the value of the output voltage Vo and a resistance ratio between the resistors R1 and R2. The node ND is connected to the feedback input terminal 11*b*. The DC/DC converter 11 controls the output voltage Vo by way of having the feedback voltage Vfb applied to the feedback input terminal 11*b* coincide with a predetermined DC/DC reference voltage. The DC/DC converter 11 adjusts the value of the output voltage Vo by increasing the output voltage Vo when the feedback voltage Vfb is lower than the DC/DC reference voltage, and adjust the value of the output voltage Vo by reducing the output voltage Vo when the feedback voltage Vfb is higher than the DC/DC reference voltage. As such, the DC/DC converter 11, the resistors R1 and R2 and the output capacitor Co form a power supply device providing a light emission driving voltage (the voltage Vo) to the light-emitting portions LL.

The power supply device including the DC/DC converter 11 and the LED driver 10A form a light-emitting device driving system, and the backlight portion 12A is added to the light-emitting driving system to form a light-emitting system.

The backlight portion 12A includes light-emitting portions LL of N channels, wherein the N channels are referred to as $1^{st}$ to $N^{th}$ channels. In the backlight portion 12A, the output voltage Vo of the DC/DC converter 11 is applied to the high-potential terminal of each light-emitting portion LL, as the light emission driving voltage. N is any integer equal or more than 2, for example, N is equal to 24. The light-emitting portions LL of the N channels have the same configuration. In the description below, a current flowing to the light-emitting portion LL is referred to as an LED current. In a situation where it is necessary to distinguish the light-emitting portions LL of the N channels from one another, the light-emitting portions LL of the N channels are referred to as light-emitting portions LL[1] to LL[N]. The light-emitting portion LL[i] is the light-emitting portion LL of the $i^{th}$ channel (where i is an integer).

The LED driver 10A includes driver blocks 20 of N channels, and further includes a light emission control circuit 30, a lowest voltage detection circuit 40, a sample hold circuit 50 and a feedback control circuit 60. Multiple external terminals exposing from a housing of the LED driver 10A are provided in the LED driver 10A. In FIG. 4, some external terminals included in the multiple external terminals are indicated as a light-emitting portion connecting terminal CH, a feedback signal output terminal FB and a power voltage input terminal VCC of N channels. The voltage Vi is inputted to the power voltage input terminal VCC. The LED driver 10A uses the voltage Vi as a power voltage to perform driving.

The driver blocks 20 of the N channels have the same configuration. Each driver block 20 includes the light-emitting portion connecting terminal CH, a constant current circuit 21 and a switching element 22. In each driver block 20, the switching element 22 is connected in series between the light-emitting connecting terminal CH and the constant current circuit 21. When the switching element 22 is in a turned-on state, the constant current circuit 21 operates such that a predetermined constant current flows through the light-emitting portion connecting terminal CH to the ground wire. The position for placing the switching element 22 can be any as desired (thus, for example, the switching element 22 can also be placed between the constant current circuit 21 and the ground wire), given that the switching element 22 is placed on the path along which the constant current of the constant current circuit 21 flows.

In a situation where it is necessary to distinguish the driver blocks 20 of the N channels from one another, the driver blocks 20 of the N channels are referred to as driver blocks 20[1] to 20[N]. The driver block 20[i] is the driver block 20 of the $i^{th}$ channel (where i is an integer). The light-emitting portion connecting terminal CH, the constant current circuit 21 and the switching element 22 in the driver block 20[i] are sometimes referenced as denotations "CH[i]", "21[i]" and "22[i]". The light-emitting portion connecting terminal CH[i], the constant current circuit 21[i] and the switching element 22[i] are respectively the light-emitting portion connecting terminal CH, the constant current circuit 21 and the switching element 22 of the $i^{th}$ channel (where i is an integer).

Each light-emitting portion connecting terminal CH is connected to the low-potential terminal of the corresponding light-emitting portion LL. Because the driver block 20 (i.e., 20[i]) of the $i^{th}$ channel corresponds to the light-emitting portion LL (i.e., LL[i]) of the $i^{th}$ channel, the light-emitting portion connecting terminal CH[i] is connected to the low-potential terminal of the light-emitting portion LL[i]. Thus, when the switching element 22[i] in in a turned-on state, the constant current of the constant current circuit 21[i] serves as an LED current that flows from the output terminal 11*a* and passes through the light-emitting portion LL[i], the light-emitting portion connecting terminal CH[i] and the switching element 22[i], and the light-emitting LL[i] emits light as a result. When the switching element 22[i] is in a turned-off state, the light-emitting portion LL[i] and the constant current circuit 21[i] are disconnected, and thus the current does not flow to the light-emitting portion LL[i] and the light-emitting portion LL[i] does not emit light.

The light emission control circuit 30 generates a PWM signal at each channel according to light emission setting information, and provides the PWM signal to the switching element 22 with respect to each channel. Accordingly, the duty cycle of the switching element 22 is controlled with respect to each channel. The light emission setting information is determined according to a signal from the CPU 13 (in other words, provided from the CPU 13). With respect to any $i^{th}$ channel, the switching element 22[i] is alternatingly turned on and turned off in predetermined unit intervals (referring to FIG. 6). The unit interval arrives at a predetermined period, and an ending time point of a certain unit interval coincides with a starting time point of a next unit interval. In the first embodiment, one unit interval coincides with one PWM interval (an example where the two do not coincide is to be described in the second embodiment). Regarding the switching element 22[i], the PWM interval includes an on interval in which the switching element 22[i] is in the turn-on state and an off interval in which the switching element 22[i] is in the turned-off state, and the ratio of the duration of the on interval to the duration of the PWM interval is the duty cycle of the switching element 22[i].

In each driver block 20, the corresponding light-emitting portion LL is pulsed to emit light by turning on and turning off the switching element 22[i] according to the PWM signal. As the duty cycle of the switching element 22[i] increases or decreases, the average light emission brightness of the light-emitting portion LL[i] also increases or decreases.

Further, the value of the constant current in the constant current circuit 21 of each channel is variable, and the value of the constant current of each constant current circuit 21 is also controlled by the light emission control circuit 30 according to the light emission setting information. As the constant current of the constant current circuit 21[i] increases or decreases, the light emission brightness of the light-emitting portion LL[i] also increases or decreases. Although the value of the constant current of the constant current circuit 21 with respect to each channel can be set according to the light emission setting information, the value of the constant current circuit 21 is set as being common among the $1^{st}$ to $N^{th}$ channels herein.

A display region of the LCD panel 14 is divided in $1^{st}$ to $N^{th}$ areas, and the light-emitting portion LL[i] is allocated to the light source with respect to the $i^{th}$ area. Further, if the light emission brightness of the corresponding light-emitting portion LL is adjusted according to the brightness of an image displayed in the areas, local dimming in N segments can be achieved. Alternatively, multiple light-emitting systems in FIG. 4 can be provided in the display apparatus 1, and local dimming of an integer multiple of N can be achieved.

The voltage in the light-emitting portion connecting terminal CH[i] is referred to as a terminal voltage, and is represented by the denotation "V[i]". The terminal voltages in the channels, i.e., the terminal voltages V[1] to V[N], are provided to the lowest voltage detection circuit 40.

The lowest voltage detection circuit 40 detects a lowest voltage among the terminal voltages V[1] to V[N], and outputs the lowest voltage detected as a voltage $V_{LS}$. The output voltage $V_{LS}$ of the circuit 40 changes each time the lowest voltage among the terminal voltages V[1] to V[N] changes. That is to say, for example, among the terminal voltages V[1] to V[N], if the terminal voltage V[1] is the lowest voltage at a $1^{st}$ time point and the terminal voltage V[2] is the lowest voltage at a subsequent $2^{nd}$ time point, the voltage $V_L$, at the $1^{st}$ time point coincides with the terminal voltage V[1] at the $1^{st}$ time point, and the voltage $V_{LS}$ at the $2^{nd}$ time point coincides with the terminal voltage V[2] at the $2^{nd}$ time point.

However, if the voltage $V_L$s exceeds a predetermined upper voltage limit (e.g., 5 V), such voltage exceeding the upper voltage limit is not outputted from the circuit 40. Thus, in a situation where the all the terminal voltages V[1] to V[N] are above the upper voltage limit, the voltage $V_{LS}$ becomes the upper voltage limit. Assuming that the switching element 22[1] is turned off and the LED current does not flow to the light-emitting portion LL[i], the terminal voltage V[i] becomes equal or more than the upper voltage limit. Hence, it can also be understood as that the lowest voltage detection circuit 40 is a circuit that detects the terminal voltage V[1] when the switching element 22[1] is set to the turned-on state, the terminal voltage V[2] when the switching element 22[2] is set to the turned-on state, . . . , and terminal voltage V[N] when the switching element 22[N] is set to the turned-on state, and outputs the lowest voltage detected as the voltage $V_{LS}$ (when all the switching elements 22[1] to 22[N] are in the turned-off state, the voltage $V_{LS}$ coincides with the upper voltage limit).

The sample hold circuit 50 appropriately updates the voltage held thereby (to be referred to as a hold voltage $V_{LS_SH}$) according to the output voltage $V_{LS}$ of the lowest voltage detection circuit 40, and outputs the voltage $V_{LS_SH}$ to the feedback control circuit 60. The sample hold circuit 50 constantly compares the hold voltage $V_{LS_SH}$ with the output voltage $V_{LS}$ of the circuit 40, and keeps the hold voltage $V_{LS_SH}$ if the output voltage $V_{LS}$ is higher than the hold voltage $V_{LS_SH}$, or updates the hold voltage $V_{LS_SH}$ to the current output voltage $V_{LS}$ if the output voltage $V_{LS}$ is lower than the hold voltage $V_{LS_SH}$.

The feedback control circuit 60 generates a feedback signal Sfb according to the hold voltage $V_{LS_SH}$ provided from the sample hold circuit 50 and a predetermined reference voltage $V_{REF}$, and outputs the feedback signal Sfb from a feedback signal output terminal FB. The feedback output terminal FB is connected to the node ND, and a feedback voltage Vfb changes according to the feedback signal Sfb. Thus, the feedback control circuit 60 can control the output voltage Vo (the light emission driving voltage) of the DC/DC converter 11 according to the feedback signal Sfb. The reference voltage $V_{REF}$ is a predetermined positive DC voltage (e.g., 1 V) lower than the upper voltage limit. The hold voltage $V_{LS_SH}$ at the startup of the LED driver 10 can be higher than the reference voltage $V_{REF}$.

Figure 5:
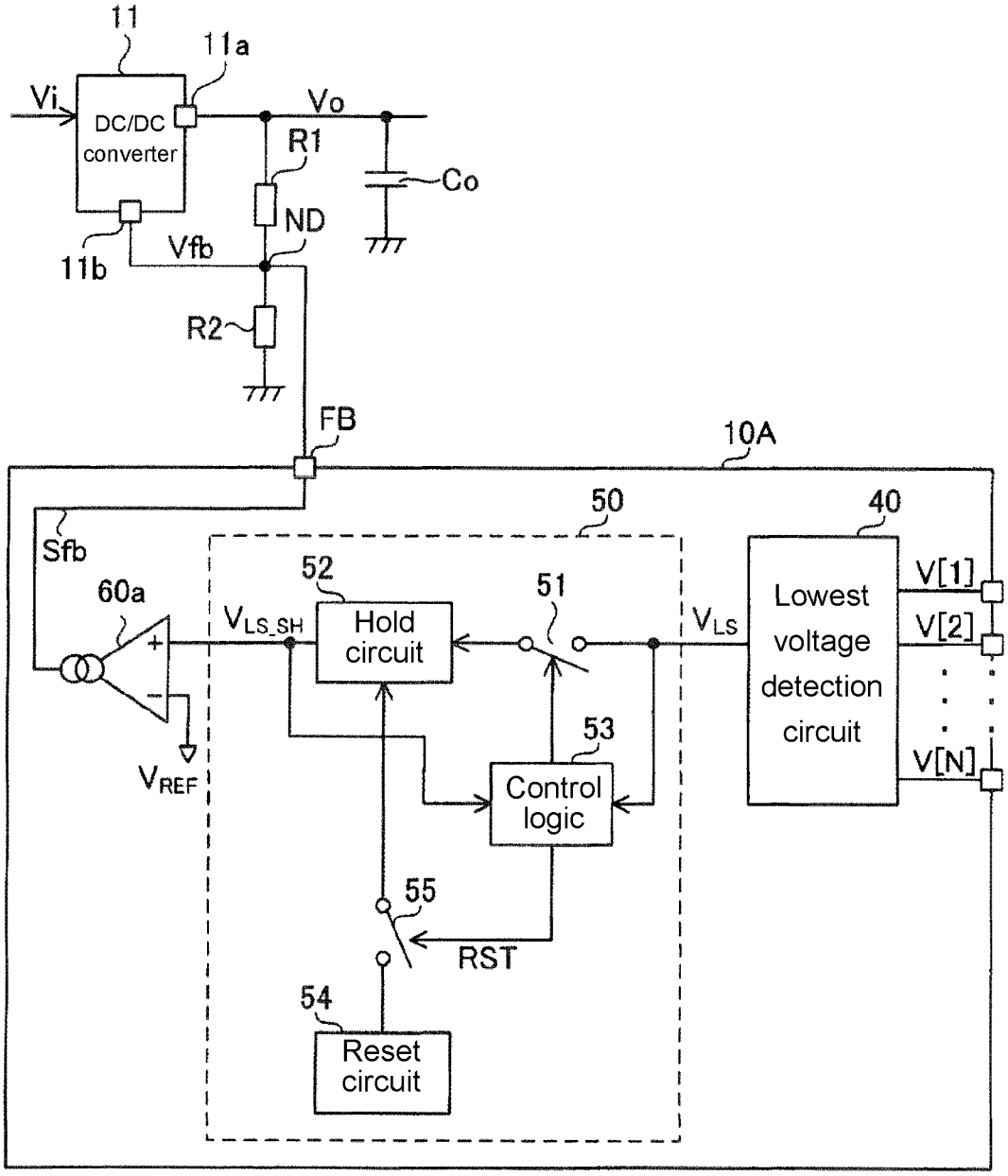
FIG. 5 is a configuration diagram of parts related to output control of a direct-current (DC)/DC converter according to the first embodiment of the present invention.

FIG. 5 shows a configuration diagram of parts related to control of the output voltage Vo. As shown in FIG. 5, the sample hold circuit 50 includes a sample switching element 51, a hold circuit 52, a control logic 53, a reset circuit 54 and a reset switching element 55. In FIG. 5, the feedback control circuit 60 is formed by an error amplifier 60*a*.

The switching element 51 is connected in series on a wire between the lowest voltage detection circuit 40 and the hold circuit 52. When the switching element 51 is in the turned-off state, the hold circuit 52 does not change and keeps the hold voltage $V_{LS_SH}$ held thereby. When the switching element 51 is in the turned-on state, the output voltage $V_{LS}$ of the circuit 40 is inputted to the hold circuit 52, and the hold circuit 52 updates the hold voltage $V_{LS_SH}$ to the inputted voltage $V_{LS}$. The hold voltage $V_{LS_SH}$ is outputted from the hold circuit 52. Turning on and off of the switching element 51 is controlled by the control logic 53.

The voltage $V_{LS}$ from the circuit 40 and the hold voltage $V_{LS_SH}$ from the hold circuit 52 are inputted to the control logic 53. The control logic 53 compares the voltage $V_{LS}$ with the hold voltage $V_{LS_SH}$, sets the switching element 51 to the turned-off state if the voltage $V_{LS}$ is higher than the hold voltage $V_{LS_SH}$, and sets the switching element 51 to the turned-on state if the voltage $V_{LS}$ is lower than the hold voltage $V_{LS_SH}$, and the voltage $V_{LS}$ is provided to the hold circuit 52 at this point. However, in a period in which the switching element 55 is in the turned-on state by performing a reset process below, the switching element 55 is not dependent on the high/low relationship between the voltages $V_{LS}$ and $V_{LS_SH}$ and is kept in the turned-off state.

The reset circuit 54 is a circuit capable of outputting a predetermined initial voltage. Only when the switching element 55 disposed between the reset circuit 54 and the hold circuit 52 is on the turned-on state, the initial voltage from the reset circuit 54 is inputted to the hold circuit 52. The hold circuit 52 sets the hold voltage $V_{LS_SH}$ to the initial voltage (that is to say, updates to the initial voltage) upon receiving the input of the initial voltage. The process of setting the hold voltage $V_{LS_SH}$ to the initial voltage is referred to as a reset process. The control logic 53 controls turning on and off of the switching element 55 by providing the reset signal RST to the switching element 55. Thus, the control logic 53 controls the execution of the reset process. The initial voltage can coincide with the reference voltage $V_{REF}$, or can be higher than the reference voltage $V_{REF}$.

The error amplifier 60*a* includes a non-inverting input terminal, an inverting input terminal and an output terminal. In the error amplifier 60*a*, the hold voltage $V_{LS_SH}$ from the hold circuit 52 is inputted to the non-inverting input terminal, the reference voltage $V_{REF}$ having a predetermined positive DC voltage value is inputted to the inverting input terminal, and the output terminal is connected to the feedback signal output terminal FB. The error amplifier 60*a* is a current output type transconductance amplifier, and hence an error current signal corresponding to a difference between the hold voltage $V_{LS_SH}$ and reference voltage $V_{REF}$ is outputted from an output terminal of the error amplifier 60*a*, as the feedback signal Sfb. That is to say, the error amplifier 60*a* converts a voltage signal of the differential voltage between the hold voltage $V_{LS_SH}$ and reference voltage $V_{REF}$ to the error current signal (the feedback signal Sfb).

Because the feedback signal output terminal FB is connected to the node ND, the current based on the error current signal is inputted and outputted with respect to the node ND. Further, a resistor can also be placed between the terminal FB and the node ND.

More specifically, when the hold voltage $V_{LS_SH}$ is higher than the reference voltage $V_{REF}$, the error amplifier 60*a* outputs, by increasing the potential at the node ND, a current based on the error current signal (the feedback signal Sfb) from the output terminal thereof through the terminal FB toward the node ND. With the output of the current, control for reducing the output voltage Vo is performed in the DC/DC converter 11. That is to say, when the hold voltage $V_{LS_SH}$ is higher than the reference voltage $V_{REF}$, the error current signal (the feedback signal Sfb) for reducing the output voltage Vo is generated.

Conversely, when the hold voltage $V_{LS_SH}$ is lower than the reference voltage $V_{REF}$, the error amplifier 60*a* feeds in, by reducing the potential at the node ND, a current based on the error current signal (the feedback signal Sfb) from the node ND through the terminal FB toward the output terminal thereof. With the feed of the current, control for increasing the output voltage Vo is performed in the DC/DC converter 11. That is to say, when the hold voltage $V_{LS_SH}$ is lower than the reference voltage $V_{REF}$, the error current signal (the feedback signal Sfb) for increasing the output voltage Vo is generated.

As the absolute value of the difference between the hold voltage $V_{LS_SH}$ and the reference voltage $V_{REF}$ increases, the value of the current based on the error current signal also increases.

Figure 6:
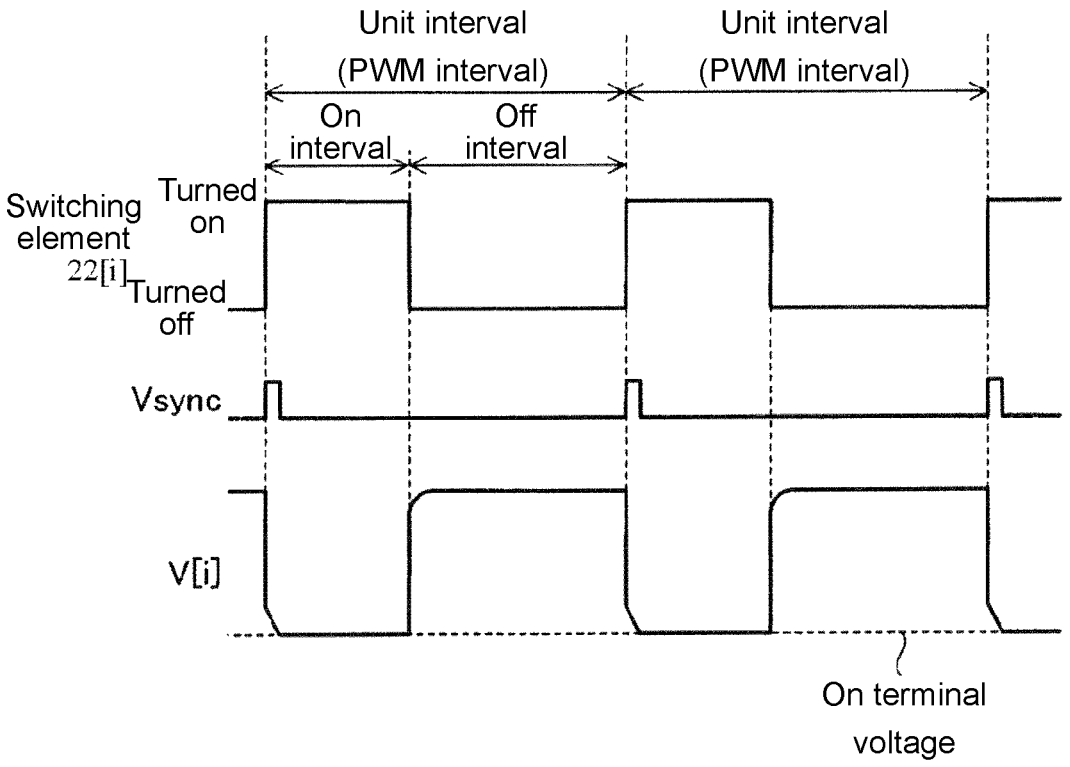
FIG. 6 is a relationship diagram showing unit intervals, turn-on and turn-off control of a switching element, and the voltage of a light-emitting portion connecting terminal according to the first embodiment of the present invention.

Further, herein, as shown in FIG. 6, in each unit interval, it is set that the on interval of the switching element 22[i] is first generated, and then the off interval of the switching element 22[1] is generated (however, the sequences of the two can be swapped). If a transitional state and a leakage current are omitted, no voltage drop is generated at the light-emitting portion LL[i] during the off interval of the switching element 22[i], and so the terminal voltage V[i] coincides with the voltage Vo. In the on interval of the switching element 22[i], the voltage lower than the voltage Vo by the voltage drop in the light-emitting portion LL[i] becomes the terminal voltage V[i].

The unit intervals in all channels are common. As shown in FIG. 6, the duration of the unit interval can also be specified according to the vertical synchronization signal Vsync. Herein, the vertical synchronization signal Vsync is set to be synchronous with the beginning of the unit interval. The vertical synchronization signal Vsync is a synchronization signal that sets the reciprocal of the frame rate of the image displayed on the LCD panel 14 as the frequency, and the display image of the LCD panel 14 is updated according to the cycle of the vertical synchronization signal Vsync. More specifically, the vertical synchronization signal Vsync is a signal generating a pulse at a fixed interval, and the interval of the pulse generated is equivalent to the cycle of the vertical synchronization signal Vsync (that is, the reciprocal of the frequency of the vertical synchronization signal Vsync). In the example in FIG. 6, a new unit interval begins each time the vertical synchronization signal Vsync generates a pulse, and the duration of the one unit interval coincides with the cycle of the vertical synchronization signal Vsync. However, the duration of one unit interval can be an integer multiple of the cycle of the vertical synchronization signal Vsync, or can be specified separately from the cycle of the vertical synchronization signal Vsync.

Further, for better illustrations below, a term "on terminal voltage" (referring to FIG. 6) is introduced. In the first embodiment, the on terminal voltage associated with a channel refers to a voltage of the light-emitting connecting terminal CH of the channel when the switching element 22 of the channel is set to the turned-on state and the LED current flows to the light-emitting portion LL of the channel. Therefore, for example, the on terminal voltage V[i] refers to the terminal voltage V[i] when the switching element 22[i] is in the turned-on state and the LED current flows to the light-emitting portion LL[i].

Operation examples EX1_1 and EX1_2 are given below for the operation of the light-emitting system of the first embodiment. A first reference operation example for comparison with the operation example EX1_1 is first described. Further, a second reference operation example for comparison with the operation example EX1_2 is also be to described below.

First Reference Operation Example

Figure 7:
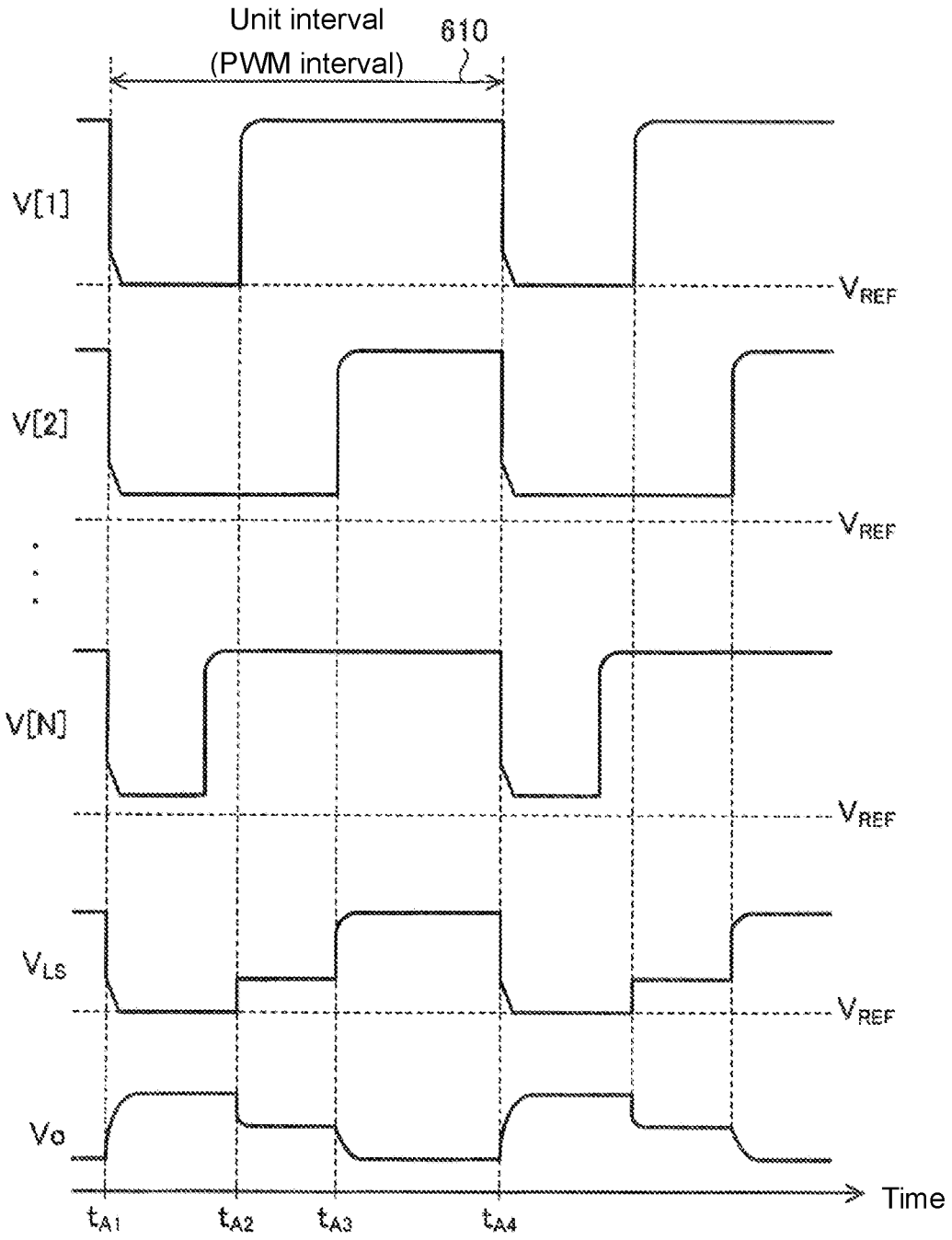
FIG. 7 is a diagram of voltage waveforms of various parts of a first reference operation example.

FIG. 7 shows waveforms of the terminal voltages V[1] to V[N], the lowest voltage $V_{LS}$ and the output voltage Vo in the first reference operation example. In the first reference operation example, different from the description above, it is assumed that the voltage $V_{LS}$ is applied to the non-inverting input terminal of the error amplifier 60*a*, which is equivalent that a condition "$V_{LS_SH}=V_{LS}$" is always true. In FIG. 7, the following situation α is assumed. In the situation α, one unit interval 610 is focused, and time points $t_{A1}$ to $t_{A4}$ are defined as below. As time progress, the times points $t_{A1}$, $t_{A2}$, $t_{A3}$ and $t_{A4}$ sequentially arrive. In the situation α, the time points $t_{A1}$ and $t_{A4}$ are a starting time point and an ending time point of the focused unit interval 610, between the time points $t_{A1}$ and $t_{A2}$ is an on interval of the switching element 22[1], between the time points $t_{A2}$ and $t_{A4}$ is an off interval of the switching element 22[1], between the time points $t_{A1}$ and $t_{A3}$ is an on interval of the switching element 22[2], and between the time points $t_{A3}$ and $t_{A4}$ is an off interval of the switching element 22[2].

Due to an error in the forward voltage of each LED forming the light-emitting portion LL, the voltage drops in the light-emitting portions LL[1] to LL[N] among the light-emitting portions LL when the LED current flows can be different from one another. In the situation α, the voltage drop in the light-emitting portion LL[1] among the light-emitting portions LL when the LED current flows is the largest, only the switching element 22[2] among the switching elements 22[1] to 22[N] is set to the turned-on state between the time points $t_{A2}$ and $t_{A3}$, and all of the switching elements 22[1] to 22[N] are set to the turned-off state between the time points $t_{A3}$ and $t_{A4}$. Therefore, in the situation α, the terminal voltage V[1] between the time points $t_{A1}$ and $t_{A2}$ is detected as the lowest voltage $V_{LS}$, and the terminal voltage V[2] between the time points $t_{A2}$ and $t_{A3}$ is detected as the lowest voltage $V_{LS}$. Between the time points $t_{A3}$ and $t_{A4}$, all of the terminal voltages V[1] to V[N] become higher than the upper voltage limit, and the voltage $V_{LS}$ coincides with the upper voltage limit.

Errors can exist in the on terminal voltage in multiple channels due to the error in the forward voltage among the light-emitting portions. With respect to a channel having terminal voltage that is too low, the LED current can be inadequate. To suppress such inadequacy of the LED current, a method of applying a sufficiently high output voltage Vo to each light-emitting portion LL in advance without performing feedback to the DC/DC converter 11 is also considered. However, in this method, there is a concern that excessive heat is generated while the on terminal voltage is increased in futile. Therefore, to avoid the inadequacy of the LED current and to suppress excessive heat generation, a feedback method of returning feedback to the DC/DC converter 11 by way of having the lowest reference voltage among the on terminal voltages of all channels become a predetermined reference voltage is developed.

In the first reference operation example, the feedback method above is adopted. However, the voltage $V_{LS}$ is persistently applied to the non-inverting terminal of the error amplifier 60*a*, and so the output voltage Vo of the DC/DC converter 11 changes frequently within one unit interval. Such change in the output voltage Vo can cause jittering of light emission brightness of the light-emitting portions LL perceivable to the eyes of a user, and is considered unsatisfactory.

Operation Example EX1_1

Figure 8:
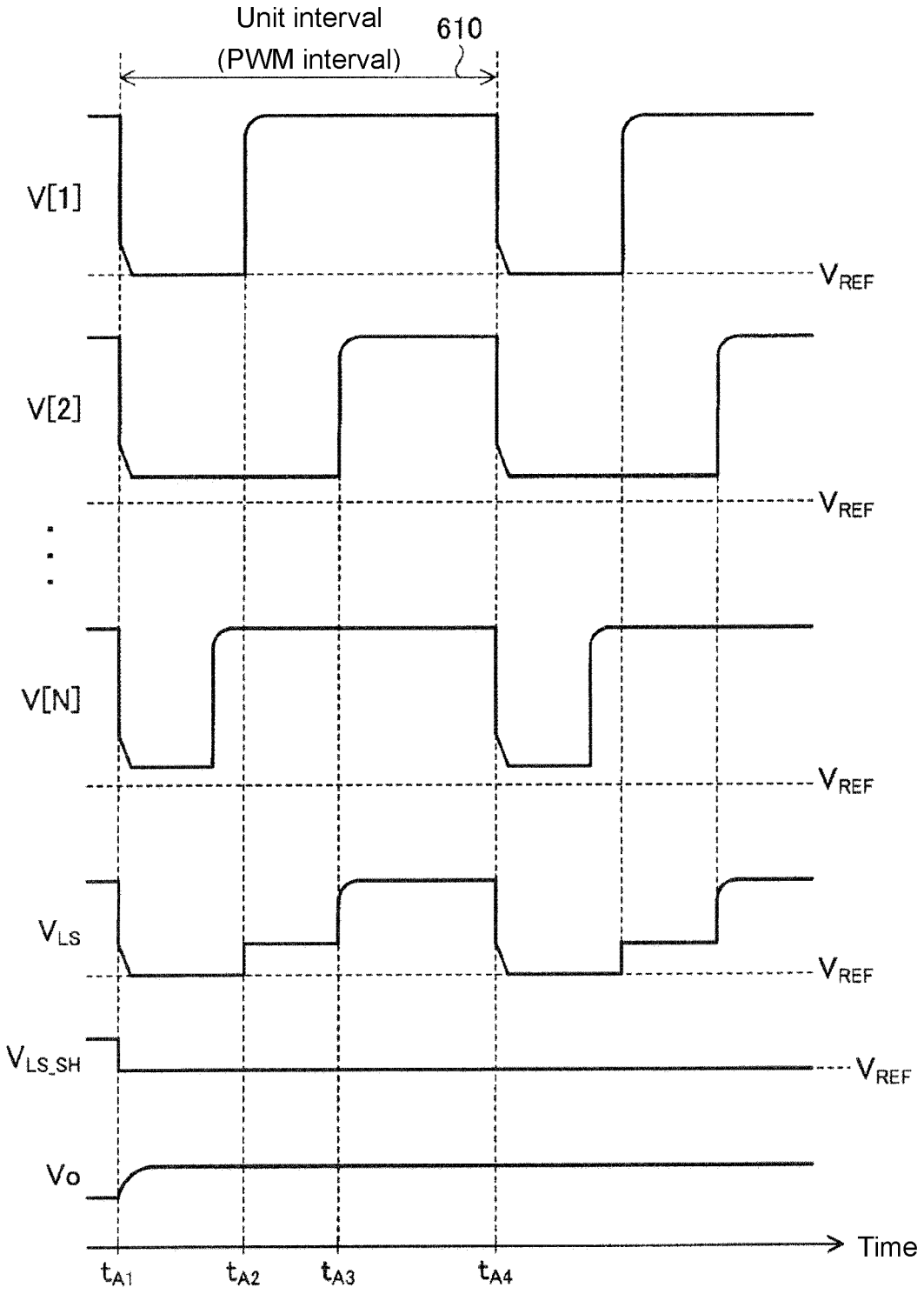
FIG. 8 is a diagram of voltage waveforms of various parts of a first operation example (EX1_1) according to the first embodiment of the present invention.

Considering the situation above, in this embodiment, the sample hold circuit 50 is used in aim of stabilization of the voltage provided to the non-inverting input terminal of the error amplifier 60*a*. An operation example for realizing the stabilization, i.e., the operation example EX1_1, is given below. FIG. 8 shows waveforms of the terminal voltages V[1] to V[N], the lowest voltage $V_{LS}$, the hold voltage $V_{LS_SH}$ and the output voltage Vo in the operation example EX1_1. Further, in the operation example EX1_1, the switching element 55 in FIG. 5 is set to be kept in the turned-off state and execution of the reset process is not considered.

The situation α is also taken into account in the operation example EX1_1 Further, herein, it is assumed that the hold voltage $V_{LS_SH}$ adjacently before the time point $t_{A1}$ is higher than the terminal voltage V[1] at the time point $t_{A1}$ and the terminal voltage V[1] adjacently after the time point $t_{A1}$. As such, taking the time point $t_{A1}$ as a boundary, the switching element 51 is switched from the turned-off state to the turned-on state by the control logic 53, and between the time points $t_{A1}$ and $t_{A2}$, the hold voltage $V_{LS_SH}$ is updated to the lowest voltage $V_{LS}$ (i.e., the terminal voltage V[1]) between the time points $t_{A1}$ and $t_{A2}$. Next, using the time point $t_{A2}$ as a boundary, the voltage $V_{LS}$ from the lowest voltage detection circuit 40 increases, and thus the switching element 51 is switched from the turned-on state to the turned-off state by using the logic control 53. Then, as long as the voltage $V_{LS}$ lower than the hold voltage $V_{LS_SH}$ updated between the time points $t_{A1}$ and $t_{A2}$ is not outputted from the circuit 40, the turned off state of the switching element 51 is maintained and the voltage $V_{LS_SH}$ is kept unchanged.

In the example in FIG. 8, assuming that the lowest voltage $V_{LS}$ between the time points $t_{A1}$ and $t_{A2}$, i.e., the terminal voltage V[1], coincides with the reference voltage $V_{REF}$, the voltage $V_{LS_SH}$ after the time point $t_{A1}$ is kept coincident with the reference voltage $V_{REF}$ (with the transitional state however omitted). Thus, after the output voltage Vo increases by taking the time point $t_{A1}$ as a boundary, the output voltage Vo is substantially kept at a fixed voltage.

Accordingly, in the configuration provided with the sample hold circuit 50, by using the feedback method of returning feedback to the DC/DC converter 11, the effect of heat suppression can be enjoyed. Further, the change in the output voltage Vo such as that in the first reference operation example can be suppressed.

Second Reference Operation Example

In a stable state of the display apparatus 1 after startup, no problem is caused when the operation example EX1_1 is used. However, if the transitional response of such as the startup of the DC/DC converter 11 is taken into account, a further design is preferably added. That is to say, for example, when the display apparatus 1 is first supplied with power and the display apparatus 1 is started, the DC/DC converter 11 is also started. However, during the process of the output voltage Vo increasing from 0 V to a predetermined voltage shortly after the startup of the DC/DC converter 11, the terminal voltage (on terminal voltage) of each light-emitting portion connecting terminal is predicted to be lower than the reference voltage $V_{REF}$ or may be lower than the reference voltage $V_{REF}$ during this process. Therefore, if the following configuration is adopted, that is, if the terminal voltage lower than the reference voltage $V_{REF}$ is sampled and is used and kept as the hold voltage $V_{LS_SH}$, and the holding is not at all reset, there is a concern that the error amplifier 60*a* continues feeding the current such that the output voltage Vo of the DC/DC converter 11 increases to more than required. The overly high output voltage Vo is undesirable in terms of heat generation.

It can be considered the same situation when the value of the constant current of the constant current circuit 21 of each channel is changed by changing the light emission setting information. For example, the user of the display apparatus 1 can operate a remote controller attached to the display apparatus 1 so as to instruct the display apparatus 1 to increase or decrease the brightness of the display image in the display apparatus 1. According to the instruction, the CPU 13 sends a required command signal to the LED driver 10 (the LED driver 10A herein) in order to achieve the increase or decrease in the brightness as instructed. The light emission setting information is changed by the command signal received. The following situation β is assumed, that is, along with the change in the light emission setting information, the value of the constant current of the constant current circuit 21 of each channel changes from a current value $I_1$ to a current value $I_2$.

Figure 9:
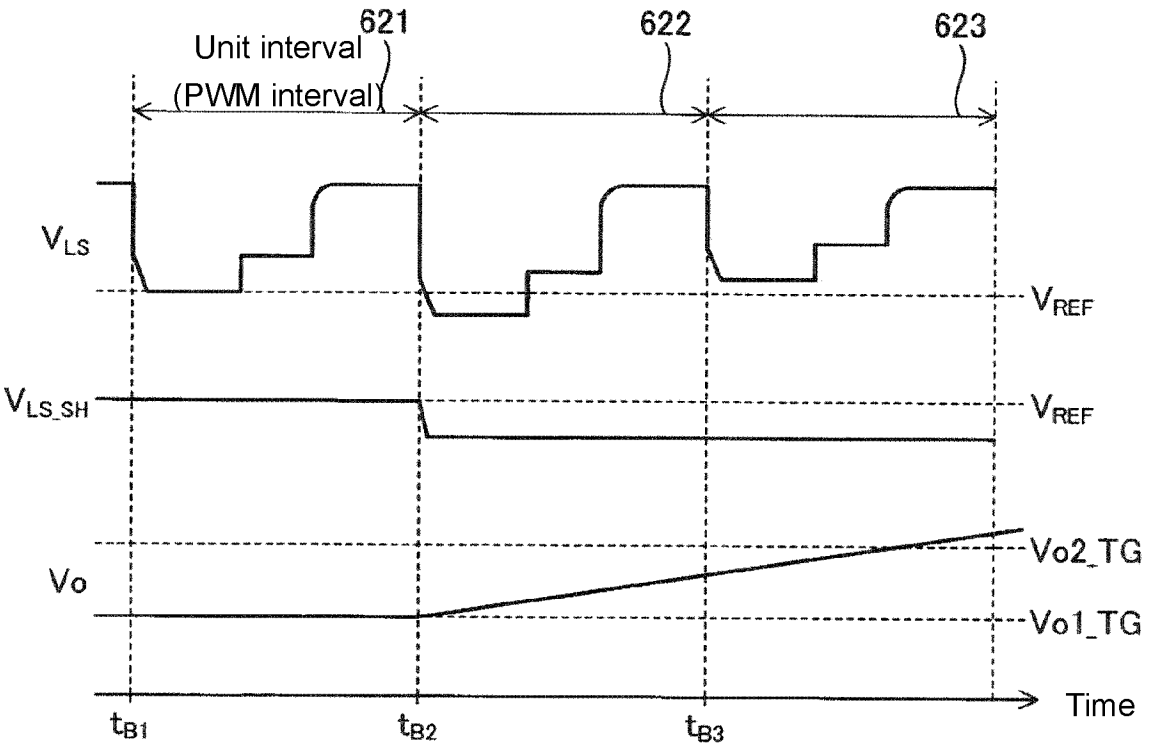
FIG. 9 is a diagram of voltage waveforms of various parts of a second reference operation example.

FIG. 9 shows waveforms of the lowest voltage $V_{LS}$, the hold voltage $V_{LS_SH}$ and the output voltage Vo in the second reference operation example. In the second example, assume that the configuration in FIG. 5 is adopted, and the reset process is similarly not performed. In FIG. 9, three consecutive unit intervals 621 to 623 are focused. As the time progresses, the unit intervals 621, 622 and 623 sequentially arrive. The unit interval 621 is a unit interval between time points $t_{B1}$ and $t_{B2}$, the unit interval 622 is a unit interval between time points $t_{B2}$ and $t_{B3}$, and the unit interval 623 is a unit interval that begins from the time point $t_{B3}$.

In FIG. 9, a situation β is assumed. In the situation β, before the time point $t_{B2}$, the value of the constant current in of the constant current circuit 21 of each channel is set to the current value $I_1$, and in at least the unit interval 621, the voltage $V_{LS_SH}$ is kept coincident with the reference voltage $V_{REF}$ and the output voltage Vo of the DC/DC converter 11 is stabilized at the voltage Vo1_TG. The voltage Vo1_TG is equivalent to the output voltage Vo suitable for supplying the LED current in the current value $I_1$ to the light-emitting portion LL of each channel.

In the situation β, the command signal is received by the LED driver 10 (the LED driver 10A herein) before the time point $t_{B2}$. Thus, by using the time point $t_{B2}$ as a boundary, the value of the constant current of the constant current circuit 21 of each channel changes from the current value $I_1$ (e.g., 20 mA) to the current value $I_2$ (e.g., 40 mA) greater than the current value $I_1$.

As such, compared to the unit interval 621, the voltage drop in each light-emitting portion LL when the LED current flows is increased in the unit interval 622. Thus, the lowest voltage $V_{LS}$ in the unit interval 622 is lower than the lowest voltage $V_{LS}$ in the unit interval 621. Accordingly, in the situation β, the lowest voltage $V_{LS}$ that is lower than the reference voltage $V_{REF}$ is sampled in the unit interval 622 so as to keep the voltage $V_{LS_SH}$ to be lower than the reference voltage $V_{REF}$.

In the second reference operation example where the reset process is not performed, once the hold voltage $V_{LS_SH}$ is lower than the reference voltage $V_{REF}$, the hold voltage $V_{LS_SH}$ stays lower than the reference voltage $V_{REF}$. Hence, there is a concern that the feedback control for increasing the output voltage Vo is continuously performed such that the output voltage Vo increases to more than required. That is to say, the voltage Vo2_TG in FIG. 9 is equivalent to the output voltage Vo suitable for supplying the LED current in the current value $I_2$ to the light-emitting portion LL of each channel. However, in the second reference operation example, there is a concern that the output voltage Vo gradually increases after exceeding the voltage Vo2_TG. Although the increase in the output voltage Vo can be limited, the increase in the output voltage Vo higher than required causes a waste in electric power and increases heat generation (further, an actual situation can be different, and in FIG. 9, it is simply indicated that the output voltage Vo after the time point $t_{62}$ rises in a substantially straight line).

Operation Example EX1_2

Figure 10:
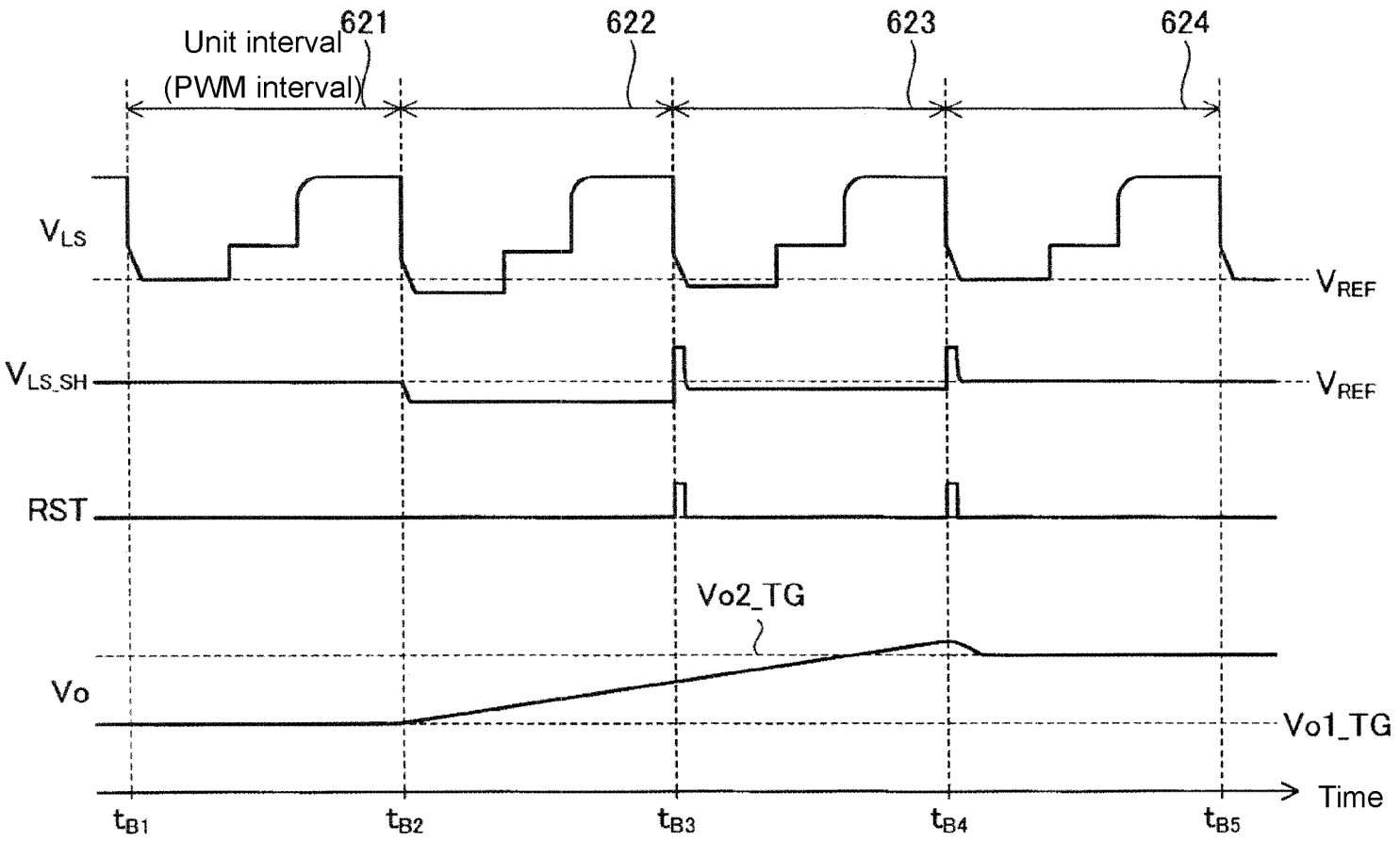
FIG. 10 a diagram of voltage waveforms of various parts of a second operation example (EX1_2) according to the first embodiment of the present invention.

Considering the described situation, in this embodiment, the reset process that can reset the hold voltage $V_{LS_SH}$ to the initial voltage is formed. The operation example EX1_2 as an operation example with the reset process being performed is described below. FIG. 10 shows waveforms of the lowest voltage $V_{LS}$, the hold voltage $V_{LS_SH}$ and the output voltage Vo in the operation example EX1_2. Further, the reset signal RST inputted to the reset switching element 55 is also depicted in FIG. 10. The reset signal RST is a signal in a low level or a high level, and herein, the switching element 55 becomes the turned-on state only when the reset signal RST is at a high level.

In the operation example EX1_2, the situation β is also assumed. In FIG. 10, four consecutive unit intervals 621 to 624 are focused. As the time progresses, the unit intervals 621, 622, 623 and 624 sequentially arrive. The unit intervals 621, 622, 623 and 624 are respectively a unit interval between the time points $t_{B1}$ and $t_{B2}$, a unit interval between the time points $t_{B2}$ and $t_{B3}$, a unit interval between the time points $t_{B3}$ and $t_{B4}$, and a unit interval between the time points $t_{B4}$ and $t_{B5}$.

As described above, in the situation β, the value of the constant current of the constant current circuit 21 of each channel is set to the current value $I_1$ before the time point $t_{B2}$, and in at least the unit interval 621, the voltage $V_{LS_SH}$ is kept coincident with the reference voltage $V_{REF}$ and the output voltage Vo of the DC/DC converter 11 is stabilized at the voltage Vo1_TG. Further, the command signal is received by the LED driver 10 (the LED driver 10A herein) before the time point $t_{B2}$. Thus, by using the time point $t_{B2}$ as a boundary, the value of the constant current of the constant current circuit 21 of each channel changes from the current value $I_1$ (e.g., 20 mA) to the current value $I_2$ (e.g., 40 mA) greater than the current value $I_1$.

As such, compared to the unit interval 621, the voltage drop in each light-emitting portion LL when the LED current flows is increased in the unit interval 622. Thus, the lowest voltage $V_{LS}$ in the unit interval 622 is lower than the lowest voltage $V_{LS}$ in the unit interval 621. Accordingly, in the situation β, the lowest voltage $V_{LS}$ that is lower than the reference voltage $V_{REF}$ is sampled in the unit interval 622 so as to keep the voltage $V_{LS}$ to be lower than the reference voltage $V_{REF}$.

If the hold voltage $V_{LS_SH}$ is lower than the reference voltage $V_{REF}$, the output voltage Vo of the DC/DC converter 11 increases through the effect of the error amplifier 60*a*. During the interval in which the hold voltage $V_{LS_SH}$ is lower than the reference voltage $V_{REF}$, the output voltage Vo of the DC/DC converter 11 gradually increases (further, an actual situation can be different, and in FIG. 10, it is simply indicated that the output voltage Vo after the time points $t_{B2}$ and $t_{B4}$ rises in a substantially straight line).

The reset signal RST is kept at a low level before the time point $t_{B3}$. At the time point $t_{B3}$, the logic control 53 restores the level of the reset signal RST to a low level after setting the reset signal RST to a high level for infinitesimal time. Thus, the reset process is performed at the time point $t_{B3}$, and the hold voltage $V_{LS_SH}$ coincides with the initial voltage only in the high-level interval of the reset signal RST. Herein, the initial voltage is set to be higher than the reference voltage $V_{REF}$. After the level of the reset signal RST has become low level, the hold voltage $V_{LS_SH}$ can be updated according to a comparison result of the hold voltage $V_{LS_SH}$ and the lowest voltage $V_L$s from the lowest voltage detection circuit 40. In the example in FIG. 10, after the reset process at the time point $t_3$, the lowest voltage $V_{LS}$ lower than the reference voltage $V_{REF}$ is obtained in an initial phase of the unit interval 623, and the hold voltage $V_{LS_SH}$ is updated to the lowest voltage $V_{LS}$.

Then, in the example in FIG. 10, in between the unit interval 623, the output voltage Vo of the DC/DC converter 11 reaches the voltage Vo2_TG (that is to say, the output voltage Vo suitable for supplying the LED current in the current value $I_2$ to the light-emitting portion LL of each channel).

At the time point $t_{B4}$, the control logic 53 again restores the level of the reset signal RST to a low level shortly after setting the level of the reset signal RST to a high level for infinitesimal time. Thus, the reset process is again performed at the time point $t_{B4}$, and the hold voltage $V_{LS_SH}$ coincides with the initial voltage only in the high-level interval of the reset signal RST. After the level of the reset signal RST has become low level, the hold voltage $V_{LS_SH}$ can be updated according to a comparison result of the hold voltage $V_{LS_SH}$ and the lowest voltage $V_{LS}$ from the lowest voltage detection circuit 40. In the example in FIG. 10, after the reset process at the time point $t_{B4}$, the lowest voltage $V_{LS}$ coincident with the reference voltage $V_{REF}$ is obtained in an initial phase of the unit interval 624, and the hold voltage $V_{LS_SH}$ is updated to the lowest voltage $V_{LS}$. After that, the lowest voltage $V_{LS}$ is not lower than the reference voltage $V_{REF}$. Therefore, after updating the hold voltage $V_{LS_SH}$ to the lowest voltage $V_{SL}$ coincident with the reference voltage $V_{REF}$, the hold voltage $V_{LS_SH}$ is kept as the reference voltage $V_{REF}$, and accordingly, the output voltage Vo is stabilized near the voltage Vo2_TG.

After performing the reset process, when it is made sure that the hold voltage $V_{LS_SH}$ has reached the reference voltage $V_{REF}$, the control logic 53 determines that the output voltage Vo has reached near the voltage Vo2_TG and sets the reset process not to be performed thereafter.

As described above, in the operation example EX1_2, maintaining of the overly low hold voltage $V_{LS_SH}$ as that in the second reference operation example (referring to FIG. 9) can be avoided. As a result, the output voltage Vo increasing to more than required can be prevented, thereby easily obtaining an expected output voltage Vo and suppressing excessive heat generation.

It can be said that, the operation below is performed in the sample hold circuit 50 with respect to the reset process. That is to say, the sample hold circuit 50 starts periodic execution of the reset process if a predetermined reset start condition is true, and then ends the periodic execution of the reset process according to the relationship between the hold voltage $V_{LS_SH}$ updated to the output voltage (i.e., the lowest voltage $V_{LS}$) of the lowest voltage detection circuit 40 and the reference voltage $V_{REF}$.

For example, the reset start condition is true if the value of the constant current of the constant current circuit 21 changes from one current value to another current value (e.g., changing from the current value $I_1$ to the current value $I_2$).

Further, for example, when the LED driver 10 (the LED driver 10A herein) is started, the reset start condition is also true. When power is supplied to the display apparatus 1 and the display apparatus 1 is started, the LED driver (the LED driver 10A herein) is also started along with the DC/DC converter 11, and shortly after the two have started, the output voltage Vo is in a progress of increasing from 0V to the predetermined voltage. Thus, the LED driver 10 (the LED driver 10A herein) including the sample hold circuit 50 is started according to the voltage Vi provided to the power voltage input terminal VCC, and it is accordingly understood as that the reset start condition is true.

In any situations of transitional changes in output voltage Vo of the DC/DC converter 11, the reset start condition can also be true.

After the periodic execution of the reset process has started, the control logic 53 can determine that a reset end condition is true upon observing that the hold voltage $V_{LS_SH}$ updated to the output voltage (i.e., the lowest voltage $V_{LS}$) of the lowest voltage detection circuit 40 coincides with the reference voltage $V_{REF}$, and end the periodic execution of the reset process. More specifically, for example, in each unit interval after the periodic execution of the reset process has started, the hold voltage $V_{LS_SH}$ is updated to the output voltage (i.e., the lowest voltage $V_L$) of the circuit 40 by turning on the sample switching element 51, and the control logic 53 refers and uses the hold voltage $V_{LS_SH}$ immediately before the unit interval ends as a determination voltage. Moreover, the control logic 53 compares the determination voltage with the reference voltage $V_{REF}$, determines that the reset end condition is true if a difference between the determination voltage and the reference voltage $V_{REF}$ is less than a predetermined infinitesimal voltage, and ends the periodic execution of the reset process. Alternatively, the reset end condition can be determined as true if a state in which the difference between the determination voltage and the reference voltage $V_{REF}$ is less than the predetermined infinitesimal voltage lasts for multiple unit intervals, and the periodic execution of the reset process is ended. The infinitesimal voltage can be understood as substantially zero.

Second Embodiment

The second embodiment of the present invention is to be described below. The second embodiment as well as third and fourth embodiments below are embodiments on the basis of the first embodiment. For items not particularly described in the second to fourth embodiment, given that there is not contradiction, the details of the first embodiment are also applicable to the second to fourth embodiment. In the explanation regarding the second embodiment, for any contradictory items between the first and second embodiments, the details of the second embodiment prevail (the same applies to the third and fourth embodiment). Given that there is no contradiction, any multiple embodiments among the first to fourth embodiments can be combined as desired.

Figure 11:
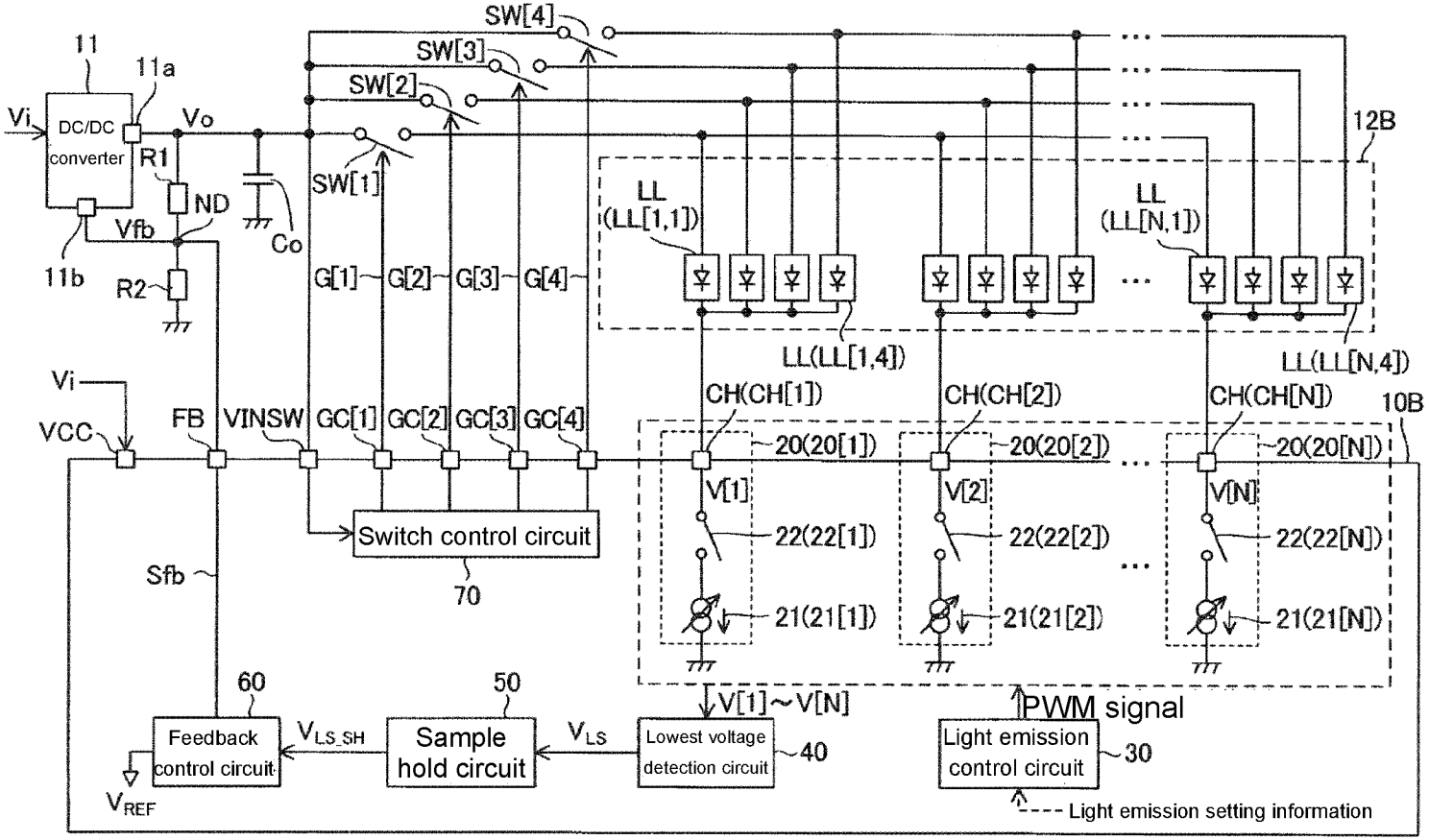
FIG. 11 is a configuration diagram of a backlight portion and parts related to light emission control according to a second embodiment of the present invention.

FIG. 11 shows the connection relationship of an LED driver 10B, the DC/DC converter 11 and a backlight portion 12B according to the second embodiment, and the configuration of the LED driver 10B and the backlight portion 12B according to the second embodiment. The LED driver 10B and the backlight portion 12B are respectively examples of the LED driver 10 and the backlight portion 12 in FIG. 2. The display apparatus 1 in the second embodiment also includes switching elements SW[1] to SW[M], where M is any integer equal or more than 2. Herein, M is set to 4 for specific description.

A light-emitting device driving system is formed by a power supply device including the DC/DC converter 11 and the LED driver 10B, and the backlight portion 12B is added to the light-emitting device driving system to form a light-emitting system. Alternatively, the switching elements SW[1] to SW[M] can be considered as being included in the constituting components of the light-emitting device driving system and the light-emitting system.

The switching element SW[i] has a first terminal, a second terminal and a control terminal. A switch control signal G[j] is provided to the control terminal of the switching element SW[i], and turning on and off of the switching element SW[i] is controlled according to the switch control signal G[j] (where j is an integer). The switching elements SW[1] to SW[4] can be configured in advance as P-channel metal-oxide-semiconductor field-effect transistors (MOSFETs) In this case, the first terminal, the second terminal and the control terminal of the switching element SW[j] are equivalent to the source, drain and gate. The switching element SW[j] becomes the turned-on state by setting the switch control signal G[j] to a low level (that is to say, the first terminal and the second terminal of the switching element SW[j] are connected), and the switching element SW[j] becomes a turned-off state by setting the switch control signal G[j] to a high level (that is to say, the first terminal and the second terminal of the switching element SW[j] are disconnected). At this point, the high level of the switch control signal G[j] coincides with the level of the voltage Vo, and the low level of the switch control signal G[j] is lower than the level of the voltage Vo.

The backlight portion 12B includes (N×M) light-emitting portions LL. The configuration and operation details of the DC/DC converter 11 are identical to those given in the description associated with the first embodiment. However, in the second embodiment, the output terminal Vo of the DC/DC converter 11 is not directly connected to each light-emitting portion LL forming the backlight portion 12B, but is connected to the first terminal of each of the switching elements SW[1] to SW[M]. The second terminals of the switching elements SW[1] to SW[M] are respectively connected to high-potential terminals of N light-emitting portions LL.

Figure 12:
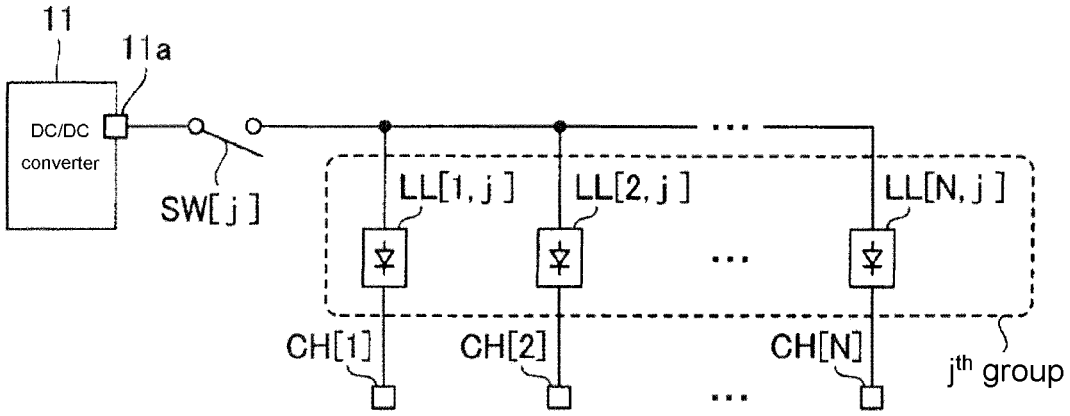
FIG. 12 is a diagram of multiple light-emitting portions belonged to a common group according to the second embodiment of the present invention.
Figure 13:
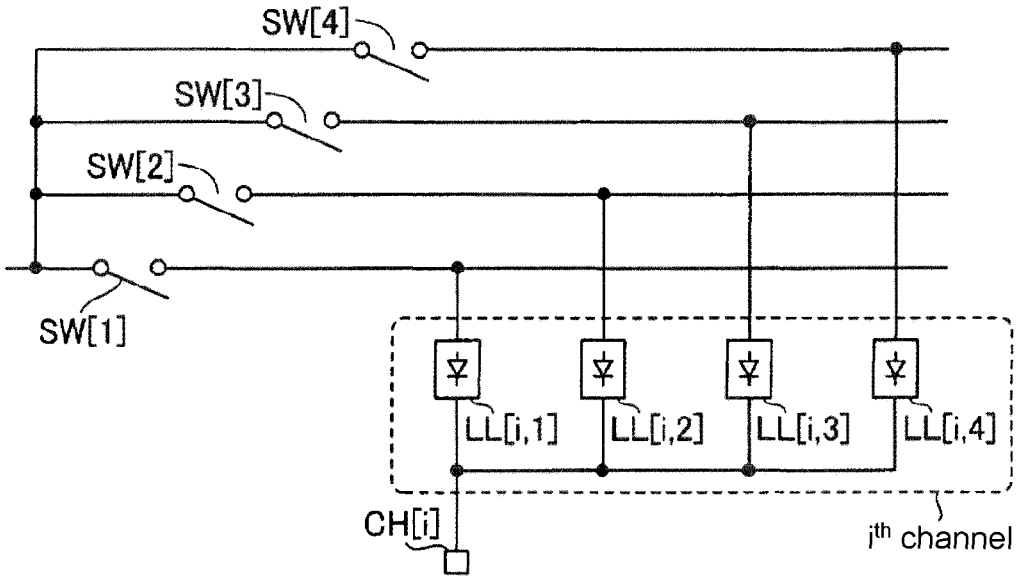
FIG. 13 is a diagram of multiple light-emitting portions belonged to a common channel according to the second embodiment of the present invention.

Again referring to FIG. 12, each light-emitting portion LL forming the backlight portion 12L uses an integer equal or more than 1 and less than N and an integer j equal or more than 1 and less than M, and is represented by a denotation "LL[i, j]". The light-emitting portion LL[i, j] is equivalent to the light-emitting portion LL placed between the second terminal of the switching element SW[j] and the light-emitting portion connecting terminal CH[i]. That is to say, the high-potential terminal of the light-emitting portion LL[i, j] is connected to the second terminal of the switching element SW[j] and the low-potential terminal of the light-emitting portion LL[i, j] is connected to the light-emitting portion connecting terminal CH[i]. A total of N light-emitting portions LL (i.e., light-emitting portions LL[1, j] to LL[N, j]) connected to the switching element SW[j] are considered to belong to a $j^{th}$ group. When the switching element SW[j] is in the turned-on state, the output voltage Vo of the DC/DC converter 11 is applied to the high-potential terminal of the light-emitting portion LL[i, j] as the light emission driving voltage, and such voltage is not applied when the switching element SW[j] is in the turned-off state and thus the LED current does not flow to the light-emitting portion LL[i, j].

It can be understood according to the description that, as shown in FIG. 3, it is considered that the low-potential terminals of the light-emitting portions LL[i, 1], LL[i, 2], LL[i, 3] and LL[i, 4] are commonly connected to the light-emitting connecting terminal CH[i], and these four light-emitting portions LL[i, 1], LL[i, 2], LL[i, 3] and LL[i, 4] belong to the $i^{th}$ channel. As such, in the second embodiment, M light-emitting portions LL (four light-emitting portions LL herein) are connected in parallel to the light-emitting portion connecting terminal CH in each channel. If (N, M) is set to (24, 4), the backlight portion 12B of the second embodiment includes, according to "24×4=96", a total of 96 light-emitting portions LL. However, the number of the light-emitting portions actually included in the backlight portion 12B can also be less than 96. That is to say, for example, the following situation can exist; that is, only two light-emitting portions LL are connected to the light-emitting portion connecting terminal CH[1] among the light-emitting portion connecting terminals CH[1] to CH[N] (in this case, the number of light-emitting portions LL included in the backlight portion 12B is in fact 94). In sum, in the LED driver 10B, the multiple light-emitting portions LL can be connected in parallel to the light-emitting portion connecting terminal CH in each channel. In the description below, unless otherwise specified, (N, M) is set to (24, 4), and the backlight portion 12B includes a total of 96 light-emitting portions LL (LL[1, 1] to LL[24, 4]).

The LED driver 10B in FIG. 11 has a configuration obtained by adding a switch control circuit 70 that is also referred to as a gate control circuit, switch control terminals GC[1] to [4] and a voltage input terminal VINSW to the LED driver 10A in FIG. 4. Apart from the additional components, the configuration and operation details of the LED driver 10B are identical to the configuration and operation details of the LED driver 10A, and the description of the first embodiment is also applicable to the second embodiment. Based on such application, "LED driver 10A" described in the first embodiment is referred to as "LED driver 10B" in the second embodiment.

Multiple external terminals exposed from a housing of the LED driver 10B are provided in the LED driver 10B, wherein the multiple external terminals include the switch control terminals GC[1] to GC[4] and the voltage input terminal VINSW. The output voltage Vo of the DC/DC converter 11 is provided to the voltage input terminal VINSW. The switch control circuit 70 generates switch control signals G[1] to G[4] by using the voltage Vo provided to the voltage input terminal VINSW. The switch control terminals GC[1] to GC[4] are respectively connected to control terminals of the switching elements SW[1] to SW[4]. The switch control circuit 70 provides the switch control signals G[1] to G[4] through the switch control terminals GC[1] to GC[4] to the control terminals of the switching elements SW[1] to SW[4], and accordingly controls turning on and off of the switching elements SW[1] to SW[4].

Using the configuration above, in the second embodiment, when the switching elements SW[j] and 22[i] are both in the turned-on state, the constant current of the constant current circuit 21[i] flows from the output terminal 11*a*, and passes through the switching element SW[j], the light-emitting portion LL[i, j], the light-emitting portion connecting terminal CH[i] and the switching element 22[i] to serve as the LED current, and the light-emitting portion LL[i, j] emits light as a result. When at least one switching element between the switching elements SW[j] and 22[i] is in the turned-off state, the current does not flow to the light-emitting portion LL[i, j] and the light-emitting portion LL[i, j] accordingly does not emit light.

Figure 14:
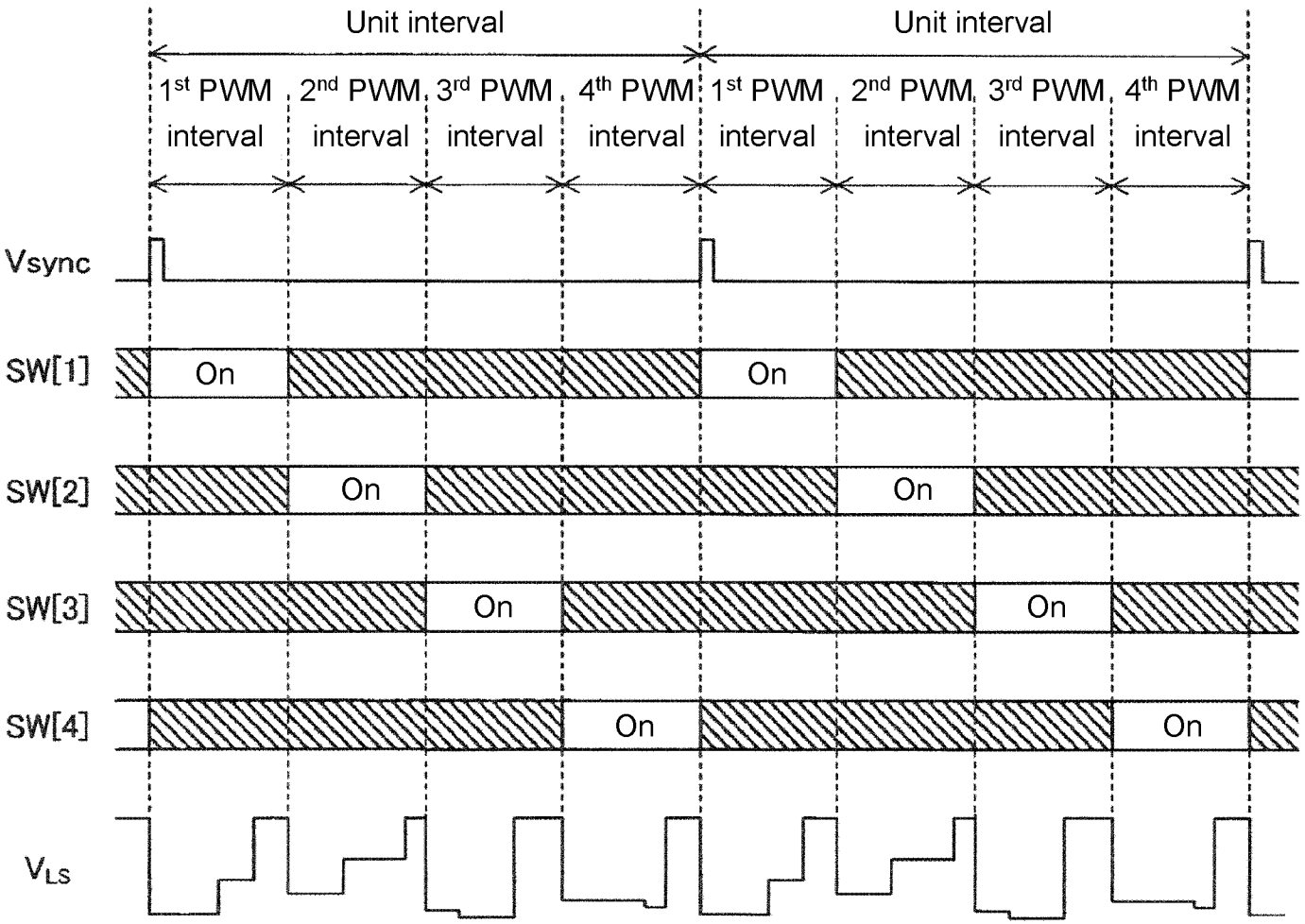
FIG. 14 is a relationship diagram showing unit intervals, four pulse-width modulation (PWM) intervals belonged to the unit interval, and states of switching elements between a DC/DC converter and a backlight portion according to the second embodiment of the present invention.

As shown in FIG. 14, in the second embodiment, each unit interval is divided into $1^{st}$ to $4^{th}$ PWM intervals. In each unit interval, the $1^{st}$, $2^{nd}$, $3^{rd}$ and $4^{th}$ PWM intervals sequentially arrive. The unit intervals are common in all the channels. As described in the first embodiment, the duration of the unit interval can also be specified according to the vertical synchronization signal Vsync. In the example in FIG. 14, a new unit interval begins each time the vertical synchronization signal Vsync generates a pulse, and the duration of the one unit interval coincides with the cycle of the vertical synchronization signal Vsync. However, the duration of one unit interval can be an integer multiple of the cycle of the vertical synchronization signal Vsync, or can be specified separately from the cycle of the vertical synchronization signal Vsync.

In each of the unit intervals, only any one of the switching elements SW[1] to SW[4] is selectively set to the turned-on state. That is to say, in the $j^{th}$ PWM interval of each unit interval, the switch control circuit 70 in FIG. 11 sets only the switching element SW[j] among the switching elements SW[1] to SW[4] to the turned-on state, and sets the remaining three switching elements to the turned-off state. The switching element SW[j] is set to the turned-on state throughout the entire $i^{th}$ PWM interval.

The light emission control circuit 30 generates a PWM signal with respect to the $1^{st}$ to $4^{th}$ PWM intervals and each channel according to the light emission setting information, and provides the PWM signal with respect to each PWM interval and each channel to the switching element 22, accordingly controlling the duty cycle of the switching element 22 with respect to each PWM interval and each channel.

That is to say, in the $1^{st}$ PWM interval, the duty cycles of the switching elements 22[1] to 22[N] are controlled according to the PWM signal generated in the $1^{st}$ PWM interval with respect to each channel, and light emission control of the light-emitting portions LL[1, 1] to LL[N, 1] belonged the first group (referring to FIG. 12) is accordingly performed. The average light emission brightness of the light-emitting portion LL[i, j] increases or decreases as the duty cycle of the switching element 22[i] in the $1^{st}$ PWM interval increases or decreases. Regarding the switching element 22[i], the $1^{st}$ PWM interval includes an on interval in which the switching element 22[i] is in the turned-on state and an off interval in which the switching interval 22[i] is in the turned-off state, and the ratio of the duration of the on interval in the $1^{st}$ PWM interval to the duration of the $1^{st}$ PWM interval is the duty cycle of the switching element 22[i] in the $1^{st}$ PWM interval. It is set in the $1^{st}$ PWM interval that, the on interval of the switching element 22[i] is first generated, and the off interval of the switching element 22[i] is then generated (however, the sequences of the two can be swapped).

Similarly, in the $2^{nd}$ PWM interval, the duty cycles of the switching elements 22[1] to 22[N] are controlled according to the PWM signal generated in the $2^{nd}$ PWM interval with respect to each channel, and light emission control of the light-emitting portions LL[1, 1] to LL[N, 1] belonged the second group (referring to FIG. 12) is accordingly performed. The average light emission brightness of the light-emitting portion LL[i, j] increases or decreases as the duty cycle of the switching element 22[i] in the $2^{nd}$ PWM interval increases or decreases. Regarding the switching element 22[i], the $2^{nd}$ PWM interval includes an on interval in which the switching element 22[i] is in the turned-on state and an off interval in which the switching interval 22[i] is in the turned-off state, and the ratio of the duration of the on interval in the $2^{nd}$ PWM interval to the duration of the $2^{nd}$ PWM interval is the duty cycle of the switching element 22[i] in the $2^{nd}$ PWM interval. It is set in the $2^{nd}$ PWM interval that, the on interval of the switching element 22[i] is first generated, and the off interval of the switching element 22[i] is then generated (however, the sequences of the two can be swapped).

The same applies to the $3^{rd}$ and $4^{th}$ PWM intervals.

As such, the in the second embodiment, the (N×M) light-emitting portions LL are divided into M groups and light emission control is performed in a time division manner. The switch control circuit 70 functions by selectively applying, in cooperation with the switching elements SW [1] to SW [M], the output voltage Vo (light emission driving voltage) of the DC/DC converter 1 to the (N×M) light-emitting portions LL in a time division manner.

The configuration and operation details of the lowest voltage detection circuit 40, the sample hold circuit 50 and the feedback control circuit 60 are identical to the configuration and operation details given in the description associated with the first embodiment. In the $1^{st}$ PWM interval, the lowest voltage among the terminal voltages V[1] to V[n] dependent on the LED forward voltage of the light-emitting portions LL belonged to the first group is outputted as the voltage $V_{LS}$ from the circuit 40; in the $2^{nd}$ PWM interval, the lowest voltage among the terminal voltages V[1] to V[n] dependent on the LED forward voltage of the light-emitting portions LL belonged to the second group is outputted as the voltage $V_{LS}$ from the circuit 40. The same applies to the $3^{rd}$ and $4^{th}$ PWM intervals.

As given in the description associated with the first embodiment, the output voltage $V_{LS}$ of the circuit 40 changes each time the lowest voltage among the terminal voltages V[1] to V[N] changes (referring to FIG. 14). That is to say, for example, among the terminal voltages V[1] to V[N], in a situation where the terminal voltage V[1] is the lowest voltage at a 1V time point and the terminal voltage V[2] at a subsequent $2^{nd}$ time point is the lowest voltage, the voltage $V_{LS}$ at the $1^{st}$ time point coincides with the terminal voltage V[1] at the $1^{st}$ time point, and the voltage $V_{LS}$ at the $2^{nd}$ time point coincides with the voltage V[2] at the $2^{nd}$ time point.

In the second embodiment, since the LED current is provided to the light-emitting portions LL in a time division manner with respect to each group, the voltage having taken into account the LED forward voltage of the (N×M) light-emitting portions LL can be obtained as the hold voltage $V_{LS_SH}$. Thus, the DC/DC converter 11 is controlled in a way that the output voltage Vo appropriate for the backlight portion 12B in overall is outputted from the DC/DC converter 11.

Thus, regarding the voltage drop in the light-emitting portions LL while the LED current flows, assuming that the voltage drop in the light-emitting portion LL[2, 3] among all of the light-emitting portions LL forming the backlight portion 12B is the largest, the terminal voltage V[2] when the LED current flows to the light-emitting portion LL[2, 3] in the $3^{rd}$ PWM interval is sampled as the hold voltage $V_{SL_SH}$ and provided to the error amplifier 60*a*.

Regarding the second embodiment, in a situation where situation α described in FIG. 6 and the operation example EX1_1 are applied, an interval obtained by combining four PWM intervals 610 is equivalent to one unit interval. Further, in one PWM interval 610 within one unit interval, the terminal voltage V[1] between the time points $t_{A1}$ and $t_{A2}$ becomes the lowest voltage $V_{LS}$ is sampled as the hold voltage $V_{LS_SH}$, and it is expected that the hold voltage $V_{LS_SH}$ stays unchanged and is maintained thereafter (however, it is assumed that the reset process is not performed).

Regarding the second embodiment, in a situation where situation β described in FIG. 10 and the operation example EX1_2 are applied, each of the unit intervals 621 to 624 includes $1^{st}$ to $4^{th}$ PWM intervals. The unit interval 621 includes the $1^{st}$ to $4^{th}$ PWM intervals, and the switching element 22 is turned on and turned off in each PWM interval within the unit interval. Thus, in the second embodiment, the waveform of the lowest voltage $V_{LS}$ in the unit interval 621 is significantly different from the waveform shown in FIG. 10. A waveform similar to the waveform of the lowest voltage $V_{LS}$ in one unit interval shown in FIG. 14 becomes the waveform of the lowest voltage $V_{L}$s in the unit interval 621. The same applies to the unit intervals 622 to 624. However, in sum, behaviors of the hold voltage $V_{LS_SH}$, the reset signal RST and the output voltage Vo are the same as those given in the description associated with the operation EX1_2 above.

In the second embodiment, the display region of the LCD panel 14 can be divided into areas AR[1, 1] to AR[N, M], and the light-emitting portion LL[i, j] is allocated to the light source corresponding to the area AR[i, j]. Further, if the light emission brightness of the corresponding light-emitting portions LL can be adjusted according to the brightness of an image displayed in the areas, local dimming in (N×M) segments can be achieved. That is to say, in order to use the configuration of the first embodiment to achieve local dimming in (N×M) segments, M LED drivers 10A are needed. However, if the configuration of the second embodiment is used, the number of the LED driver 10B needed is one, which brings better benefits for reducing overall costs of the display apparatus.

The number of the light-emitting portions LL connected to one LED driver is increased compared to the configuration of the first embodiment, and correspondingly, in the second embodiment, appropriate feedback control for the output voltage Vo becomes more critical. By using the feedback control of the circuits 40, 50 and 60, heat generation and the change in the output voltage Vo can be appropriately suppressed.

Further, multiple light-emitting systems in FIG. 11 can also be provided in the display apparatus 1. In this case, local dimming of an integer multiple of N can be achieved.

Third Embodiment

Figure 15:
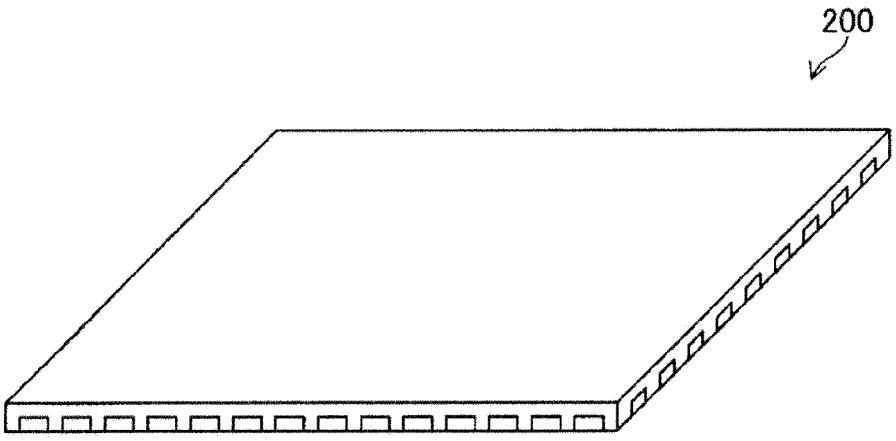
FIG. 15 is a three-dimensional appearance diagram of a driver integrated circuit according to a third embodiment of the present invention.

The third embodiment of the present invention is to be described below. The LED driver 10 is formed by using a semiconductor integrated circuit, and an electronic component accommodated with the semiconductor integrated circuit is referred to as a driver integrated circuit 200. The driver integrated circuit 200 is an electronic component formed by encapsulating a semiconductor integrated circuit forming the LED driver 10 into a housing (a package) made of resin. Multiple external terminals exposed on the outside of the driver integrated circuit 200 are provided at the housing (in other words, the housing of the LED driver 10) of the driver integrated circuit 200. FIG. 15 shows a three-dimensional appearance diagram of the driver integrated circuit 200.

Figure 16:
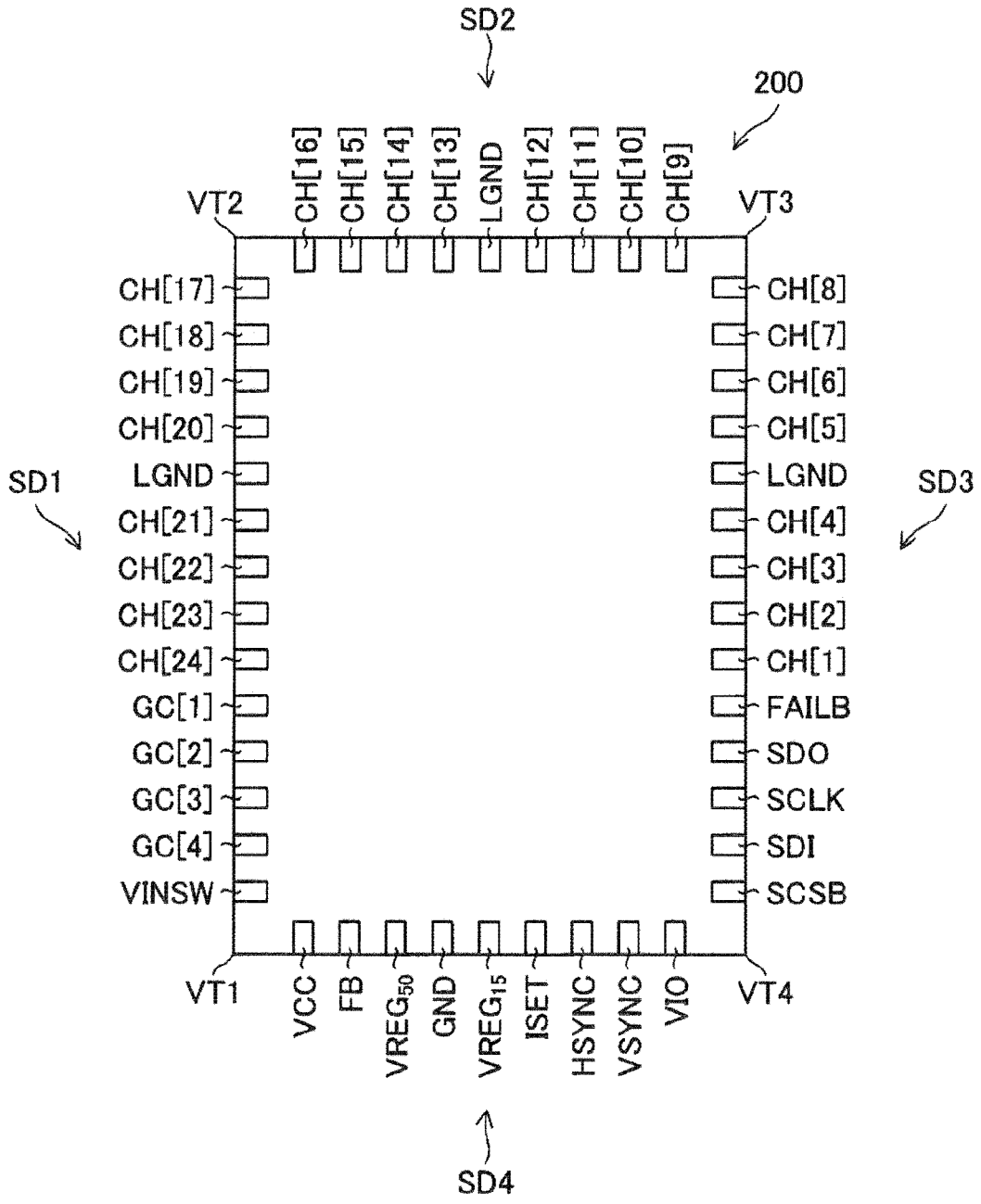
FIG. 16 is a pinout diagram showing an arrangement of external terminals of a driver integrated circuit according to the third embodiment of the present invention.
Figure 17:
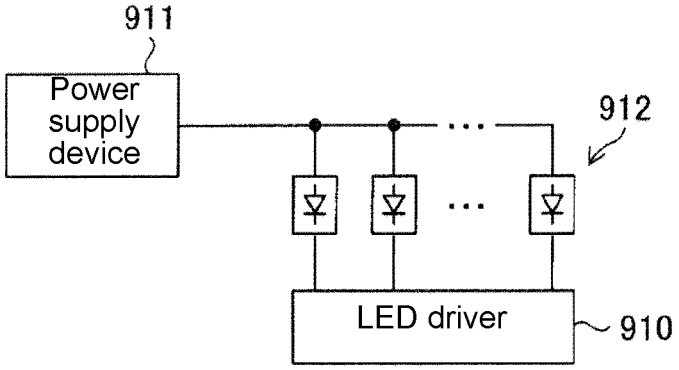
FIG. 17 is a configuration diagram of a conventional light-emitting system.

FIG. 16 shows a brief top view of the driver integrated circuit 200. An example of the driver integrated circuit 200 having a housing (a package) referred to as quad flatpack no-leads (QFN) package is given. At this point, the driver integrated circuit 200 has a housing that is substantially rectangular in shape, and multiple external terminals are arranged on four sides of a surface equivalent to a back surface of the housing, respectively (FIG. 16 is a top view observed from the side of the back surface). Further, the form of the housing of the driver integrated circuit 200 is not limited to being QFN, and can be any form such as dual flat no-leads (DFN) or small outline package (SOP).

The back surface of the housing of the driver integrated circuit 200 appears as a rectangular (including a square) in shape, and four vertices of the rectangle are respectively vertices VT1 to VT4. A side connecting the vertices VT1 and VT2, a side connecting the vertices VT2 and VT3, a side connecting the vertices VT3 and VT4, and a side connecting the vertices VT4 and VT1 are respectively referred to as sides SD1, SD2, SD3 and SD4. The sides SD1 and SD3 are parallel and opposite to each other. The sides SD2 and SD4 are parallel and opposite to each other.

The arrangement of the external terminals of the driver integrated circuit 200 shown in FIG. 16 is the arrangement used by the LED driver 10B of the second embodiment.

A total of 14 external terminals are disposed on the side SD1 On the side SD1, terminals VINSW, GC[4], GC[3], GC[2], GC[1], CH[24], CH[23], CH[22], CH[21], LGND, CH[20]. CH[19], CH[18] and CH[17] serving as external terminals are sequentially arranged from the vertex VT1 toward the vertex VT2.

A total of 9 external terminals are disposed on the side SD2. On the side SD2, terminals CH[16], CH[15], CH[14], CH[13], LGND, CH[12], CH[11], CH[10] and CH[9] serving as external terminals are sequentially arranged from the vertex VT2 toward the vertex VT3.

A total of 14 external terminals are disposed on the side SD3. On the side SD3, terminals CH[8], CH[7], CH[6], CH[5]. LGND. CH[4], CH[3], CH[2], CH[1], FAILB, SDO, SCLK, SI and SCSB serving as external terminals are sequentially arranged on from the vertex VT3 toward the vertex VT4.

A total of 9 external terminals are disposed on the side SD4. On the side SD4, terminals VIO, VSYNC, HSYNC, ISET, $VREG_{15}$, GND, $VREG_{50}$, FB and VCC serving as external terminals are sequentially arranged from the vertex VT4 toward the vertex VT1.

Functions of the terminals VINSW, GC[1] to GC[4], CH[1] to CH[24], FB and VCC are as given in the description associated with the first or second embodiment. Functions of the other terminals are described below.

The terminal LGND disposed on each of the sides SD1 to SD3 is a ground terminal to be connected to a ground wire of an analog circuit. The analog circuit includes the DC/DC converter 11 and the backlight portion 12. The LED current flows from the output terminal 11*a* of the DC/DC converter 11 through the light-emitting portion LL and the light-emitting portion connecting terminal CH to the ground terminal LGND. On the other hand, the terminal GND provided on the side SD4 is a ground terminal to be connected to a ground wire of a digital circuit. The digital circuit includes the CPU 13. The ground wire of the analog circuit and the ground wire of the digital circuit have a mutually common ground potential, and patterns are separated in a way that the input and output of currents between these circuits is as small as possible.

Communication between the CPU 13 and the driver integrated circuit 200 is implemented by a serial peripheral interface (SPI). At this point, the CPU 13 functions as a host device, and the driver integrated circuit 200 functions as a peripheral device. Communication based on SPI is realized by receiving and transmitting chip selection signals, clock signals, data input signals and data output signals. The terminals SCSB, SCLK, SDI and SDO function as communication terminals for communication based on SPI. However, in a situation where the configuration of the CPU 13 serving as a host device includes only one peripheral device, the terminal SCSB can be omitted. The terminal SCSB is a chip select terminal for receiving a chip selection signal from the CPU 13. The terminal SCLK is a clock input terminal for receiving a clock signal from the CPU 13. The terminal SDI is a data input terminal for receiving a data signal from the CPU 13. The terminal SDO is a data output terminal for receiving an output data signal from the CPU 13.

An abnormality detection circuit (not shown) for detecting whether an abnormality (a temperature-related abnormality or a voltage-related abnormality) has occurred in the driver integrated circuit 200 is provided in the driver integrated circuit 200. The terminal FAILB is a fail terminal for outputting a detection result indicative of an abnormality to the outside (e.g., the CPU 13).

The terminal VIO is a voltage input terminal for receiving a voltage the same as the power voltage. In the driver integrated circuit 200, a communication interface (not shown) in charge of communicating with the CPU 13 operates by using the voltage inputted to the terminal VIO.

The terminals VSYNC and HSYNC are terminals for receiving the vertical synchronization signal Vsync and the horizontal synchronization signal Hsync. In the driver integrated circuit 200, the unit interval can be specified by the vertical synchronization signal Vsync inputted to terminal VSYNC. The horizontal synchronization signal Hsync is equivalent to a pulse synchronization signal including the number of horizontal lines of the LCD panel 14 within one cycle of the vertical synchronization signal Vsync. In the driver integrated circuit 200, the PWM signal can also be generated by using the horizontal synchronization signal Hsync. Sometimes the terminal HSYNC is omitted from the driver integrated circuit 200.

The terminal ISET is a current setting terminal for specifying the maximum value of the constant current of the constant current circuit 21 in each channel. On the outside of the driver integrated circuit 200, a setting resistor (not shown) is provided between the terminal ISET and the ground wire, and the maximum value of the constant current is determined according to the resistant value of a setting resistor.

A regulator circuit (not shown) is provided in the driver integrated circuit 200. The regulator circuit (not shown) generates a predetermined first DC voltage (e.g., 5.0 V) and a predetermined second DC voltage (e.g., 1.5 V) according to the input voltage Vi of the power voltage input terminal VCC, and applies the first and second DC voltages to the terminals $VREG_{50}$ and $VREG_{15}$, respectively. On the outside of the driver integrated circuit 200, a capacitor is placed between the terminal $VREG_{50}$ and the ground line and between the terminal $VREG_{15}$ and the ground line.

The configuration of the external terminals is determined by separating external terminals requiring a larger withstand voltage from external terminals without such requirement as far as possible. Thus, it is then not easy to result in circuit damage caused by short circuit between adjacent terminals.

More specifically, the withstand voltages of the terminals GC[1] to GC[4], CH[1] to CH[24] and VINSW are set to a predetermined first withstand voltage, and the withstand voltages of the terminals FAILB, SDO, SCLK, SDI, SCSB, VIO, VSYNC, HSYNC, ISET and $VREG_{15}$ are set to a predetermined second withstand voltage. The first withstand voltage has a value (e.g., 40 V) equal or more than the maximum of the output voltage Vo that can be outputted from the DC/DC converter 11. The second withstand voltage is lower than the first withstand voltage, and can be in a same level (e.g., 10 V) as the withstand voltage of the terminal of the CPU 13.

The withstand voltages of the terminals FB and VCC are set to a predetermined third withstand voltage. The third withstand voltage is lower than the first withstand voltage but higher than the second withstand voltage. However, the withstand voltage of the terminals VB and VCC can also be set to the first withstand voltage or the second withstand voltage. The withstand voltages of the terminals $VREG_{50}$ and GND can be set to the second withstand voltage or the third withstand voltage. The withstand voltage of the terminal LGND can be set to the first withstand voltage, or can be set to the second or third withstand voltage.

Fourth Embodiment

The fourth embodiment of the present invention is described below. In the fourth embodiment, the application techniques, variation techniques or supplementary items suitable for the first to third embodiments are described.

In the third embodiment (FIG. 16), the arrangement of the external terminals of the LED driver 10B suitable for the second embodiment is described. However, the arrangement of the external terminals in FIG. 16 can also be applied to the LED driver 10A of the first embodiment. At this point, the terminals GC[1] to GC[4] and VINSW are set as terminals NC. The terminal NC refers to an external terminal that is not connected to any part of the semiconductor integrated circuit forming the LED driver 10A and does not provide any function.

The DC/DC converter 11 can also be formed by a semiconductor integrated circuit. In this case, a power supply integrated circuit (not shown) of a semiconductor integrated circuit forming the DC/DC converter 11 and accommodated in a housing, and the driver integrated circuit 200 of a semiconductor integrated circuit forming the LED driver 10 and accommodated in a housing are separately assembled in the display apparatus 1. However, the semiconductor integrated circuit forming the DC/DC converter 11 and the semiconductor integrated circuit forming the LED driver 10 can also be accommodated in a common housing so as to form one single driver integrated circuit.

As described above, each light-emitting portion LL includes one or more than one light-emitting device that emits light by a current provided. The LED serving as the light-emitting device can be an LED of any type, or can be an organic LED achieving organic electroluminescence (EL). Further, the light-emitting device can also be a device that is not classified as an LED, for example, a laser diode.

In this embodiment, the light-emitting device driver apparatus implemented as an LED driver is not limited to serving for backlight applications of an LCD panel, but can be used in various applications such as laser imaging detection and ranging (LIDAR) systems using laser diodes or head-up displays.

Various modifications within the range of the technical concept defined by the claims can be appropriately made to the embodiments of the present invention. The embodiments described above are merely examples of the embodiments of the present invention, and meanings of the present invention or the terms of the constituting components are not limited to the meanings described in the embodiments above. The specific values given in the description are merely examples, and can be modified to various other values.

What is claimed is:

1. A light-emitting device driving apparatus, comprising:

a plurality of driver blocks of a plurality of channels, each driver block comprising a light-emitting portion and a connecting terminal, the light-emitting portion comprising a light-emitting device, the light-emitting portion operable to emit light by current flowing in the light-emitting portion through the connecting terminal;

a lowest voltage detection circuit, operable to detect and output a lowest voltage among voltages of the connecting terminals of each channel;

a sample hold circuit including a sample switching element, a hold circuit, a control logic, a reset circuit and a reset switching element, wherein the control logic circuit is operable to compare an output voltage of the lowest voltage detection circuit with a hold voltage of the hold circuit, and wherein the hold circuit is operable to update the hold voltage to the output voltage when the output voltage is lower than the hold voltage; and a feedback control circuit, operable to output a feedback signal to a power supply device to control a light emission driving voltage provided by the power supply device, wherein the feedback signal is based on the hold voltage and a predetermined reference voltage, and the power supply device is operable to provide the light emission driving voltage to the light-emitting portions of the plurality of channels.

2. The light-emitting device driving apparatus according to claim 1, wherein each driver block further comprises:

a constant current circuit, operable to provide a constant current to the light-emitting portion through the connecting terminal; and a switching element, connected in series on a path along which the constant current flows, wherein the light-emitting portion is operable to be pulsated to emit light by turning on and off the switching element.

3. The light-emitting device driving apparatus according to claim 2, wherein, the feedback control circuit is operable to generate the feedback signal in a manner that, the light emission driving voltage decreases when the hold voltage is higher than the reference voltage, and the light emission driving voltage increases when the hold voltage is lower than the reference voltage.

4. The light-emitting device driving apparatus according to claim 1, wherein, the feedback control circuit is operable to generate the feedback signal in a manner that, the light emission driving voltage decreases when the hold voltage is higher than the reference voltage, and the light emission driving voltage increases when the hold voltage is lower than the reference voltage.

5. The light-emitting device driving apparatus according to claim 1, wherein, the sample hold circuit is operable to perform a reset process for setting the hold voltage to a predetermined initial voltage.

6. The light-emitting device driving apparatus according to claim 5, wherein, the sample hold circuit is operable to start periodic execution of the reset process when a predetermined condition is true, and end the periodic execution of the reset process according to the hold voltage and the reference voltage, wherein the hold voltage is updated to the output voltage of the lowest voltage detection circuit.

7. The light-emitting device driving apparatus according to claim 1, wherein, a plurality of the light-emitting portions are connected in parallel to the connecting terminal of each channel; and the light emission driving voltage is selectively applied in a time division manner to the plurality of light-emitting portions.

8. A light-emitting system, comprising:

a light-emitting device driving apparatus according to claim 7;

a power supply device, operable to generate the light emission driving voltage according to the feedback signal from the light-emitting device driving apparatus, and output the light emission driving voltage from an output terminal thereof; and the light-emitting portions of the plurality of channels;

wherein, the plurality of channels comprise $1^{st}$ to $N^{th}$ channels, where N is an integer equal or more than 2;

a $1^{st}$ to a $M^{th}$ light-emitting portions are connected in parallel to the light-emitting portion of each channel, where M is an integer equal or more than 2;

a $1^{st}$ switching element is connected in series between the output terminal of the power supply device and the $1^{st}$ light-emitting portion of each channel, a $2^{nd}$ switching element is connected in series between the output terminal of the power supply device and the $2^{nd}$ light-emitting portion of each channel, till an $M^{th}$ switching element is connected in series between the output terminal of the power supply device and the $M^{th}$ light-emitting portion of each channel; and the light-emitting device driving apparatus further comprises a switch control circuit, the switch control circuit selectively operable to apply the light emission driving voltage in a time division manner to the $1^{st}$ to $M^{th}$ light-emitting portions of each channel by controlling turning on and off the $1^{st}$ to the $M^{th}$ switching elements.

9. The light-emitting device driving apparatus according to claim 1, comprising:

a housing, comprising a first side and a third side opposite to each other, and a second side and a fourth side opposite to each other;

wherein, the connecting terminals of the plurality of channels are arranged on the first side, the second side and the third side; and a feedback signal output terminal for outputting the feedback signal is arranged on the fourth side.

10. The light-emitting device driving apparatus according to claim 9, wherein, the light-emitting device driving apparatus is operable to communicate with an external apparatus;

wherein, a communication terminal for communicating with the external apparatus is arranged on the third side.

11. The light-emitting device driving apparatus according to claim 10, wherein, on the third side, the communication terminal is operable to be closer to the fourth side than the connecting terminal.

12. A light-emitting device driving system, comprising:

a light-emitting device driving apparatus according to claim 1; and a power supply device, operable to generate and output the light emission driving voltage according to the feedback signal from the light-emitting device driving apparatus.

13. A light-emitting system, comprising:

a light-emitting device driving apparatus according to claim 1;

a power supply device, operable to generate and output the light emission driving voltage according to the feedback signal from the light-emitting device driving apparatus; and the light-emitting portions of the plurality of channels.

* * * * *